US009580090B2

(12) United States Patent
Kumar

(10) Patent No.: US 9,580,090 B2
(45) Date of Patent: Feb. 28, 2017

(54) SYSTEM, METHOD, AND COMPUTER READABLE MEDIUM FOR IMPROVING THE HANDLING OF A POWERED SYSTEM TRAVELING ALONG A ROUTE

(75) Inventor: Ajith Kuttannair Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 2564 days.

(21) Appl. No.: 12/274,596

(22) Filed: Nov. 20, 2008

(65) Prior Publication Data

US 2009/0090818 A1 Apr. 9, 2009

Related U.S. Application Data

(63) Continuation-in-part of application No. 11/742,568, filed on Apr. 30, 2007.

(60) Provisional application No. 60/868,240, filed on Dec. 1, 2006, provisional application No. 61/048,504, filed on Apr. 28, 2008.

(51) Int. Cl.

| | |
|---|---|
| ***B61C 17/12*** | (2006.01) |
| ***B61L 3/00*** | (2006.01) |
| ***B61C 15/00*** | (2006.01) |

(52) U.S. Cl.

CPC ..... *B61L 3/006* (2013.01); *B61C 15/00* (2013.01)

(58) Field of Classification Search

CPC ..... B61C 15/00; B61H 15/00
USPC ..... 701/19; 246/176 R, 186, 187 C, 167 D
See application file for complete search history.

(56) References Cited

U.S. PATENT DOCUMENTS

| | | | | |
|---|---|---|---|---|
| 3,217,663 | A * | 11/1965 | Donald | 105/1.4 |
| 3,273,145 | A * | 9/1966 | Joy et al. | 342/418 |
| 3,519,805 | A | 7/1970 | Thorne-Booth | |
| 3,650,216 | A | 3/1972 | Harwick et al. | |
| 3,655,962 | A | 4/1972 | Koch | |
| 3,865,042 | A | 2/1975 | DePaola et al. | |
| 4,005,838 | A | 2/1977 | Grundy | |
| 4,041,283 | A * | 8/1977 | Mosier | 701/20 |
| 4,042,810 | A | 8/1977 | Mosher | |
| 4,181,943 | A | 1/1980 | Mercer, Sr. | |

(Continued)

FOREIGN PATENT DOCUMENTS

| | | |
|---|---|---|
| EP | 1 136 969 | 9/2001 |
| EP | 1 297 982 | 4/2003 |

*Primary Examiner* — Thomas G Black
*Assistant Examiner* — Peter D Nolan
(74) *Attorney, Agent, or Firm* — John A. Kramer; Global Patent Operation

(57) ABSTRACT

A control system is provided for improving the handling of a powered system traveling along a route. The powered system includes a first and second powered vehicle respectively positioned in two consists, which are separated by at least one non-powered vehicle. The control system includes a controller configured to determine at least one slack location along the powered system. The slack location represents a force separation in the powered system between two respective regions, which include a compression region subject to a compression force and a tension region subject to a tension force. The controller is coupled to a respective engine of a powered vehicle, and the controller adjusts an output of the engine to control a rate of change of the at least one slack location along the powered system. Additionally, a method is provided for improving the handling of a powered system traveling along a route.

21 Claims, 18 Drawing Sheets

(56) References Cited

U.S. PATENT DOCUMENTS 4,253,399 A 3/1981 Spigarelli
4,279,395 A 7/1981 Boggio et al.
4,344,364 A * 8/1982 Nickles et al. ..... 105/62.1
4,401,035 A 8/1983 Spigarelli et al.
4,561,057 A 12/1985 Haley, Jr. et al.
4,602,335 A 7/1986 Perlmutter
4,711,418 A 12/1987 Aver, Jr. et al.
4,735,385 A 4/1988 Nickles et al.
4,794,548 A 12/1988 Lynch et al.
4,827,438 A 5/1989 Nickles et al.
4,853,883 A 8/1989 Nickles et al.
5,109,343 A 4/1992 Budway
5,398,894 A 3/1995 Pascoe
5,437,422 A 8/1995 Newman
5,440,489 A 8/1995 Newman
5,507,400 A 4/1996 Long et al.
5,676,059 A 10/1997 Alt
5,744,707 A 4/1998 Kull
5,758,299 A 5/1998 Sandborg et al.
5,785,392 A 7/1998 Hart
5,828,979 A 10/1998 Polivka et al.
5,950,967 A * 9/1999 Montgomery ..... 246/182 R
6,112,142 A 8/2000 Shockley et al.
6,125,311 A 9/2000 Lo
6,144,901 A 11/2000 Nickles et al.
6,269,034 B1 7/2001 Shibuya
6,273,521 B1 * 8/2001 Halvorson et al. ..... 303/7
6,308,117 B1 10/2001 Ryland et al.
6,487,488 B1 11/2002 Peterson, Jr. et al.
6,505,103 B1 1/2003 Howell et al.
6,516,727 B2 2/2003 Kraft
6,551,039 B1 4/2003 Forbes
6,591,758 B2 7/2003 Kumar
6,609,049 B1 8/2003 Kane et al.
6,612,245 B2 9/2003 Kumar et al.
6,612,246 B2 9/2003 Kumar
6,615,118 B2 9/2003 Kumar
6,691,957 B2 2/2004 Hess, Jr. et al.
6,694,231 B1 2/2004 Rezk
6,732,023 B2 5/2004 Sugita et al.
6,760,712 B1 7/2004 Bonissone et al.
6,763,291 B1 7/2004 Houpt et al.
6,789,005 B2 9/2004 Hawthorne
6,810,312 B2 10/2004 Jammu et al.
6,821,065 B2 11/2004 Forbes
6,824,110 B2 11/2004 Kane et al.
6,845,953 B2 1/2005 Kane et al.
6,853,888 B2 2/2005 Kane et al.
6,856,865 B2 2/2005 Hawthorne
6,863,246 B2 3/2005 Kane et al.
6,865,454 B2 3/2005 Kane et al.
6,903,658 B2 6/2005 Kane et al.
6,915,191 B2 7/2005 Kane et al.
6,922,619 B2 7/2005 Baig et al.
6,957,131 B2 10/2005 Kane et al.
6,978,195 B2 12/2005 Kane et al.
6,980,894 B1 12/2005 Gordon et al.
6,996,461 B2 2/2006 Kane et al.
7,021,588 B2 * 4/2006 Hess et al. ..... 246/186
7,021,589 B2 4/2006 Hess, Jr. et al.
7,024,289 B2 4/2006 Kane et al.
7,036,774 B2 5/2006 Kane et al.
7,079,926 B2 7/2006 Kane et al.
7,092,800 B2 8/2006 Kane et al.
7,092,801 B2 8/2006 Kane et al.
7,360,979 B2 4/2008 Forbes
2002/0059075 A1 5/2002 Schick et al.
2002/0096081 A1 7/2002 Kraft
2003/0213875 A1 * 11/2003 Hess et al. ..... 246/167 R
2004/0133315 A1 7/2004 Kumar et al.
2004/0245410 A1 12/2004 Kisak et al.
2005/0065674 A1 3/2005 Houpt et al.
2005/0120904 A1 6/2005 Kumar et al.
2007/0219680 A1 9/2007 Kumar et al.
2007/0219681 A1 * 9/2007 Kumar et al. ..... 701/19

* cited by examiner

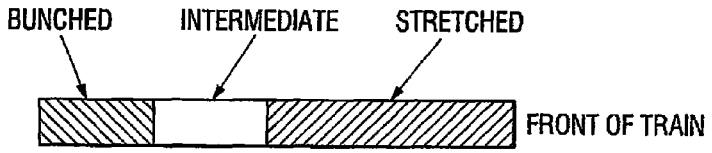
FIG. 3
FIG. 4
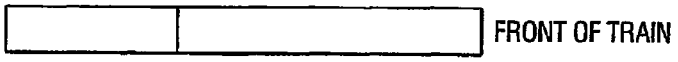
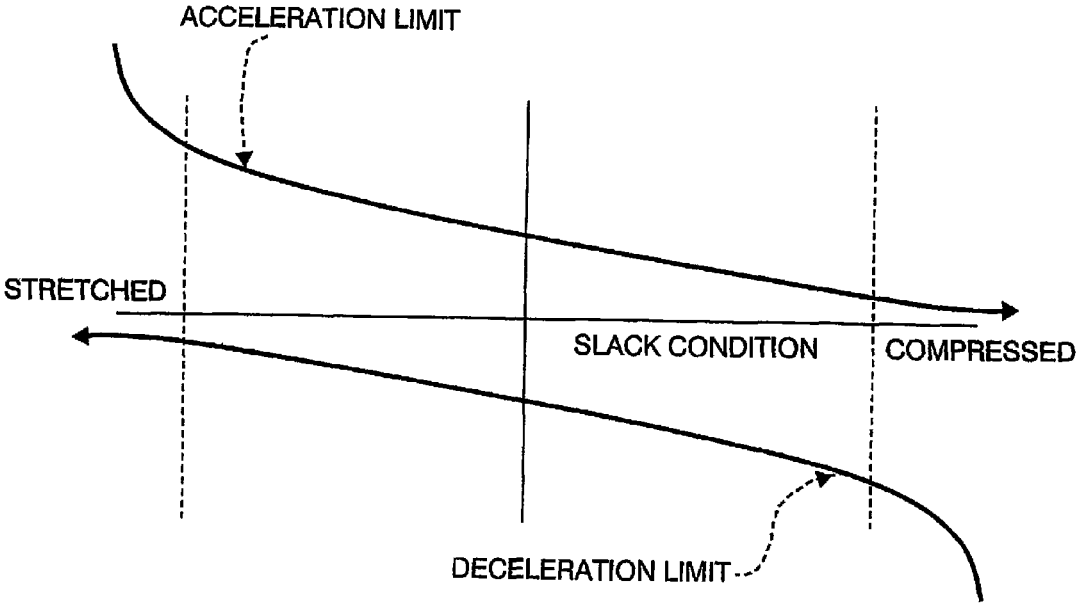
FIG. 5

SYSTEM, METHOD, AND COMPUTER READABLE MEDIUM FOR IMPROVING THE HANDLING OF A POWERED SYSTEM TRAVELING ALONG A ROUTE

CROSS-REFERENCE TO RELATED APPLICATIONS

This application claims priority to and is a Continuation-In-Part of U.S. application Ser. No. 11/742,568 filed Apr. 30, 2007, which claims priority to U.S. Provisional Application No. 60/868,240 filed Dec. 1, 2006, which is incorporated herein by reference in its entirety.

This application also claims the benefit of U.S. Provisional Application No. 61/048,504 filed Apr. 28, 2008.

BACKGROUND OF THE INVENTION

A locomotive is a complex system with numerous subsystems, where each subsystem is interdependent on other subsystems. An operator aboard a locomotive applies tractive and braking effort to control the speed of the locomotive and its load of railcars to assure proper operation and timely arrival at the desired destination. Speed control must also be exercised to maintain in-train forces within acceptable limits, thereby avoiding excessive coupler forces and the possibility of a train break or derailment. To perform this function and comply with prescribed operating speeds that may vary with the train's location on the track, the operator generally must have extensive experience operating the locomotive over the specified terrain with different railcar consists (a "consist" being a designated group of locomotives or other railcars).

A train may include one or more locomotive consists, or respective groupings of locomotives, traveling along a route. During operation of the locomotive consists, one or more slack locations, or locations of minimal or zero in-train force, may develop along the length of the train. As the train moves along the route, these slack locations may propagate along the length of the train, and cause severe handling issues in the operation of the train.

Heretofore, the availability of a control system which forecasts the development of slack locations along the length of the train, and controls the movement of such slack locations as the train travels along the route, has not been ascertainable. If the development of slack locations is not forecasted, and the movement of the slack locations is not controlled once they have developed, the handling of the train may be adversely affected. Thus, it would be advantageous to provide a control system that recognizes the necessary conditions for the development of slack locations, and is capable of maintaining the operating parameters of the locomotive consist(s) of the train such that developed slack locations do not adversely affect the handling of the train.

BRIEF DESCRIPTION OF THE INVENTION

In an embodiment of the present invention, a control system is provided for improving the handling of a powered system traveling along a route. The powered system includes a first and second powered vehicle respectively positioned in two consists, which are separated by at least one non-powered vehicle. The control system includes a controller configured to determine at least one slack location along the powered system. The slack location represents a force separation in the powered system between two respective regions, which include a compression region subject to a compression force and a tension region subject to a tension force. The controller is coupled to a respective engine of a powered vehicle, and the controller adjusts an output of the engine to control a rate of change of the at least one slack location along the powered system.

In another embodiment a method is provided for improving the handling of a powered system traveling along a route. The method includes determining at least one slack location along the powered system. Additionally, the method includes adjusting an output of an engine of the at least one powered vehicle to minimize a rate of change of the at least one slack location along the powered system.

In yet another embodiment, a control system is provided for improving the handling of a powered system traveling along a route. The control system includes a controller configured to determine a plurality of slack locations along the powered system, where each slack location represents a force separation in the powered system between two respective regions of the powered system. The two respective regions of the powered system include a compression region subject to a compression force and a tension region subject to a tension force. The controller adjusts a power output of at least one of the powered vehicles to control at least one respective characteristic of each of the slack locations.

BRIEF DESCRIPTION OF THE DRAWINGS

A more particular description of the embodiments of the invention will be rendered by reference to specific embodiments thereof that are illustrated in the appended drawings. Understanding that these drawings depict only typical embodiments of the invention and are not therefore to be considered limiting of its scope, the invention will be described and explained with additional specificity and detail through the use of the accompanying drawings in which:

FIGS. 3 and 4 depict slack condition displays according to different embodiments of the invention;

FIG. 5 graphically depicts acceleration and deceleration limits based on the slack condition;

DETAILED DESCRIPTION OF THE INVENTION

Figure 1:
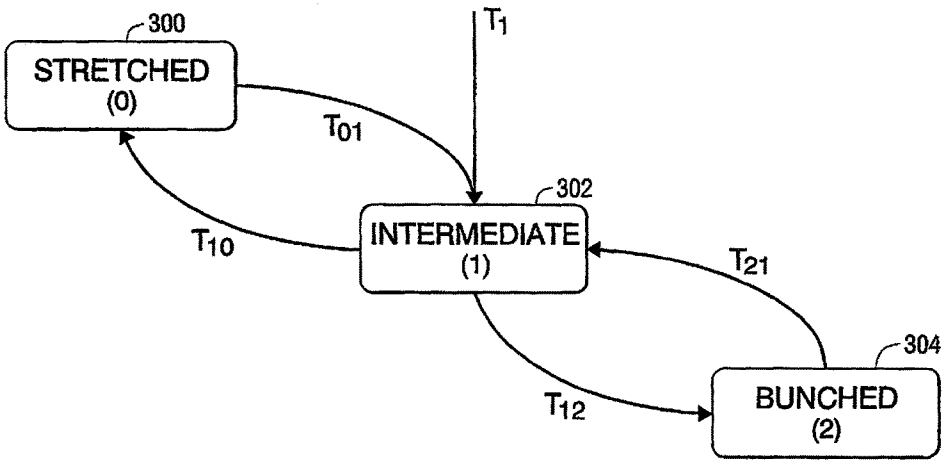
FIGS. 1 and 2 graphically depict slack conditions of a railroad train.

Reference will now be made in detail to the embodiments consistent with aspects of the invention, examples of which are illustrated in the accompanying drawings. Wherever possible, the same reference numerals used throughout the drawings refer to the same or like parts.

Embodiments of the present invention solve certain problems in the art by providing a system, method, and computer implemented method for limiting in-train forces for a railway system, including in various applications, a locomotive consist, a maintenance-of-way vehicle, and a plurality of railcars. The present embodiments are also applicable to a train including a plurality of distributed locomotive consists, referred to as a distributed power train, typically including a lead consist and one or more non-lead consists.

Persons skilled in the art will recognize that an apparatus, such as a data processing system, including a CPU, memory, I/O, program storage, a connecting bus, and other appropriate components, could be programmed or otherwise designed to facilitate the practice of the method of the invention embodiments. Such a system would include appropriate program means for executing the methods of these embodiments.

In another embodiment, an article of manufacture, such as a pre-recorded disk or other similar computer program product, for use with a data processing system, includes a storage medium and a program recorded thereon for directing the data processing system to facilitate the practice of the method of the embodiments of the invention. Such apparatus and articles of manufacture also fall within the spirit and scope of the embodiments.

The disclosed invention embodiments teach methods, apparatuses, and programs for determining a slack condition and/or quantitative/qualitative in-train forces and for controlling the railway system responsive thereto to limit such in-train forces. To facilitate an understanding of the embodiments of the present invention they are described hereinafter with reference to specific implementations thereof.

According to one embodiment, the invention is described in the general context of computer-executable instructions, such as program modules, executed by a computer. Generally, program modules include routines, programs, objects, components, data structures, etc. that perform particular tasks or implement particular abstract data types. For example, the software programs that underlie the embodiments of the invention can be coded in different languages, for use with different processing platforms. It will be appreciated, however, that the principles that underlie the embodiments can be implemented with other types of computer software technologies as well.

Moreover, those skilled in the art will appreciate that the embodiments of the invention may be practiced with other computer system configurations, including hand-held devices, multiprocessor systems, microprocessor-based or programmable consumer electronics, minicomputers, mainframe computers, and the like. The embodiments of the invention may also be practiced in a distributed computing environment where tasks are performed by remote processing devices that are linked through a communications network. In the distributed computing environment, program modules may be located in both local and remote computer storage media including memory storage devices. These local and remote computing environments may be contained entirely within the locomotive, within other locomotives of the train, within associated railcars, or off-board in wayside or central offices where wireless communications are provided between the different computing environments.

The term "locomotive" can include (1) one locomotive or (2) multiple locomotives in succession (referred to as a locomotive consist), connected together so as to provide motoring and/or braking capability with no railcars between the locomotives. A train may comprise one or more such locomotive consists. Specifically, there may be a lead consist and one or more remote (or non-lead) consists, such as a first non-lead (remote) consist midway along the line of railcars and another remote consist at an end-of-train position. Each locomotive consist may have a first or lead locomotive and one or more trailing locomotives. Though a consist is usually considered connected successive locomotives, those skilled in the art recognize that a group of locomotives may also be consider a consist even with at least one railcar separating the locomotives, such as when the consist is configured for distributed power operation, wherein throttle and braking commands are relayed from the lead locomotive to the remote trails over a radio link or a physical cable. Towards this end, the term "locomotive consist" should be not be considered a limiting factor when discussing multiple locomotives within the same train.

Referring now to the drawings, embodiments of the present invention will be described. The various embodiments of the invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the various invention embodiments are discussed below.

In a train, two adjacent railroad railcars or locomotives are typically linked by a knuckle coupler attached to each railcar or locomotive. Generally, the knuckle coupler includes four elements, a cast steel coupler head, a hinged jaw or "knuckle" rotatable relative to the head, a hinge pin about which the knuckle rotates during the coupling or uncoupling process, and a locking pin. When the locking pin on either or both couplers is moved upwardly away from the coupler head the locked knuckle rotates into an open or released position, effectively uncoupling the two railcars/locomotives. Application of a separating force to either or both of the railcars/locomotives completes the uncoupling process.

When coupling two railcars, at least one of the knuckles must be in an open position to receive the jaw or knuckle of the other railcar. The two railcars are moved toward each other. When the couplers mate the jaw of the open coupler closes and responsive thereto the gravity-fed locking pin automatically drops in place to lock the jaw in the closed condition and thereby lock the couplers closed to link the two railcars.

Even when coupled and locked, the distance between the two linked railcars can increase or decrease due to the spring-like effect of the interaction of the two couplers and due to the open space between the mated jaws or knuckles. The distance by which the couplers can move apart when coupled is referred to as an elongation distance or coupler slack and can be as much as about four to six inches per coupler. A stretched slack condition occurs when the distance between two coupled railcars is about the maximum separation distance permitted by the slack of the two linked couplers. A bunched (compressed) condition occurs when the distance between two adjacent railcars is about the minimum separation distance as permitted by the slack between the two linked couplers.

As is known, a train operator (e.g., either a human train engineer with responsibility for operating the train, an automatic train control system that operates the train without or with minimal operator intervention, or an advisory train control system that advises the operator to implement train control operations while allowing the operator to exercise independent judgment as to whether the train should be controlled as advised) increases the train's commanded horsepower/speed by moving a throttle handle to a higher notch position and decreases the horsepower/speed by moving the throttle handle to a lower notch position or by applying the train brakes (the locomotive dynamic brakes, the independent air brakes, or the train air brakes). Any of these operator actions, as well as train dynamic forces and the track profile, can affect the train's overall slack condition and the slack condition between any two linked couplers.

When referred to herein, "tractive effort" further includes braking effort, and "braking effort" further includes braking actions resulting from the application of the locomotive dynamic brakes, the locomotive independent brakes, and/or the air brakes throughout the train.

The in-train forces that are managed by the application of tractive effort (TE) or braking effort (BE) are referred to as "draft forces" (a pulling force or a tension force) on the couplers and draft gear during a stretched slack state, and are referred to as "buff forces" (compression force) during a bunched or compressed slack condition. A draft gear includes a force-absorbing element that transmits draft or buff forces between the coupler and the railcar to which the coupler is attached.

A FIG. 1 state diagram depicts three discrete slack states: a stretched state 300, an intermediate state 302, and a bunched state 304. Transitions between states, as described herein, are indicated by arrowheads referred to as transitions "T" with a subscript indicating a previous state and a new state.

State transitions are caused by the application of tractive effort (that tends to stretch the train), braking effort (that tends to bunch the train), or changes in terrain that can cause either a run-in (transition towards a bunched state/condition) or a run-out (transition towards a stretched state/condition). The rate of train stretching (run-out) depends on the rate at which the tractive effort is applied as measured in horsepower/second or notch position change/second. For example, tractive effort is applied to move from the intermediate state (1) to the stretched state (0) along a transition $T_{10}$. For a distributed power train including remote locomotives spaced-apart from the lead locomotive in the train consist, the application of tractive effort at any locomotive tends to stretch the railcars following that locomotive (with reference to the direction of travel).

Generally, when the train is first powered up, the initial coupler slack state is unknown. But as the train moves responsive to the application of tractive effort the state is determinable. The transition $T_1$ into the intermediate state (1) 302 depicts the power-up scenario.

The rate of train bunching (run-in) depends on the braking effort applied as determined by the application of the dynamic brakes, the locomotive independent brakes, and/or the train air brakes.

The intermediate state 302 is not a desired state. The stretched state 300 is preferred, as train handling is easiest when the train is stretched, although the operator can accommodate a bunched state.

The FIG. 1 state machine can represent an entire train or train segments (e.g., the first 30% of the train in a distributed power train or a segment of the train bounded by two spaced-apart locomotive consists). Multiple independent state machines can each describe a different train segment, each state machine including multiple slack states such as indicated in FIG. 1. For example, a distributed power train or pusher operation can be depicted by multiple state machines representing the multiple train segments, each segment defined, for example, by one of the locomotive consists within the train.

Figure 2:
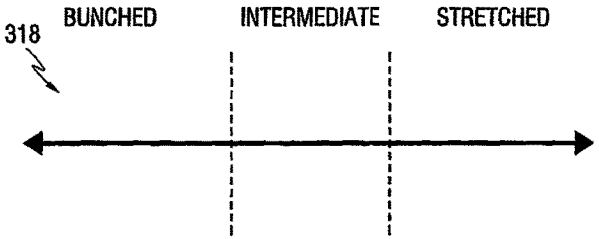

As an alternative to the discrete states representation of FIG. 1, FIG. 2 depicts a line 318 representing a continuum of slack states from a stretched state through an intermediate state to a bunched state, each state generally indicated as shown. The FIG. 2 curve more accurately portrays the slack condition than the state diagram of FIG. 1, since there are no universal definitions for discrete stretched, intermediate, and bunched states, as FIG. 1 might suggest. As used herein, the term "slack condition" refers to discrete slack states as illustrated in FIG. 1 or a continuum of slack states as illustrated in FIG. 2.

Like FIG. 1, the slack state representation of FIG. 2 can represent the slack state of the entire train or of one or more train segments. In one example, the segments are bounded by locomotive consists and the end-of-train device. One train segment of particular interest includes the railcars immediately behind the lead consist where the total forces, including steady state and slack-induced transient forces, tend to be highest. Similarly, for a distributed power train, the particular segments of interest are those railcars immediately behind and immediately ahead of the non-lead locomotive consists.

To avoid coupler and train damage, the train's slack condition can be taken into consideration when applying TE or BE. The slack condition refers to one or more of a current slack condition, a change in slack condition from a prior time or track location to a current time or current track location, and a current or real time slack transition (e.g., the train is currently experiencing a run-in or a run-out slack transition). The rate of change of a real time slack transition can also affect the application of TE and BE to ensure proper train operation and minimize damage potential.

TE and BE can be applied to the train by control elements/control functions, including, but not limited to, the operator by manual manipulation of control devices, automatically by an automatic control system, or manually by the operator responsive to advisory control recommendations produced by an advisory control system. Typically, an automatic train control system implements train control actions (and an advisory control system suggests train control actions for consideration by the operator) to optimize a train performance parameter, such as fuel consumption and/or emissions output.

In another embodiment, the operator can override a desired control strategy responsive to a determined slack condition or slack event and control the train or cause the automatic control system to control the train according to the override information. For example, the operator can control (or have the train control system control) the train in situations where the train manifest information supplied to the system for determining the slack condition is incorrect or when another discrepancy determines an incorrect slack condition. The operator can also override automatic control, including overriding during a run-in or a run-out condition.

The determined slack condition or a current slack transition can be displayed to the operator during either manual operation or when an automatic train control system is present and active. Many different display forms and formats can be utilized depending on the nature of the slack condition determined. For example, if only three discrete slack states are determined, a simple text box can be displayed to notify the operator of the determined state. If multiple slack states are identified, the display can be modified accordingly. For a system that determines a continuous slack state, the display can present a percent or number or total weight of cars stretched and bunched. Similarly, many different graphical depictions may be used to display or represent the slack condition information, such as animated bars with various color indications based on slack condition (e.g., those couplers greater than 80% stretched indicated with a green bar). A representation of the entire train can be presented and the slack condition (see FIG. 3) or changing slack condition (slack event)(see FIG. 4) depicted thereon.

Train characteristic parameters (e.g., railcar masses, mass distribution) for use by the apparatuses and methods described herein to determine the slack condition can be supplied by the train manifest or by other techniques known in the art. The operator can also supply train characteristic information, overriding or supplementing previously provided information, to determine the slack condition according to the embodiments of the invention. The operator can also input a slack condition for use by the control elements in applying TE and BE.

When a train is completely stretched, additional tractive effort can be applied at a relatively high rate in a direction to increase the train speed (i.e., a large acceleration) without damaging the couplers, since there will be little relative movement between linked couplers. Any such induced additional transient coupler forces are small beyond the expected steady-state forces that are due to increased tractive effort and track grade changes. But when in a stretched condition, a substantial reduction in tractive effort at the head end of the train, e.g., the application of excessive braking forces or the application of braking forces at an excessive rate, can suddenly reduce the slack between linked couplers. The resulting forces exerted on the linked couplers can damage the couplers, causing the railcars to collide or derail the train.

As a substantially compressed train is stretched (as noted above, this is referred to as run-out) by the application of tractive effort, the couplers linking two adjacent railcars move apart as the two railcars (or locomotives) move apart. As the train is stretching, relatively large transient forces are generated between the linked couplers as they transition from a bunched to a stretched state. In-train forces capable of damaging the coupling system or breaking the linked couplers can be produced even at relatively slow train speeds of one or two miles per hour. Thus, if the train is not completely stretched it is necessary to limit the forces generated by the application of tractive effort during slack run-out.

When the train is completely bunched, additional braking effort (by operation of the locomotive dynamic brakes or independent brakes) or a reduction of the propulsion forces can be applied at a relatively high rate without damage to the couplers, draft gears, or railcars. But the application of excessive tractive forces or the application of such forces at an excessive rate can generate high transient coupler forces that cause adjacent railcars to move apart quickly, changing the coupler's slack condition, leading to possible damage of the coupler, coupler system, draft gear, or railcars.

As a substantially stretched train is compressed (as noted above, this is referred to as run-in) by applying braking effort or reducing the train speed significantly by moving the throttle to a lower notch position, the couplers linking two adjacent cars move together. An excessive rate of coupler closure can damage the couplers, damage the railcars, or derail the train. Thus, if the train is not completely bunched it is necessary to limit the forces generated by the application of braking effort during the slack run-in period.

If the operator (a human operator or automatic control system) knows the current slack condition (for example, in the case of a human operator, by observing a slack condition display as described above), then the train can be controlled by commanding an appropriate level of tractive or braking effort to maintain or change the slack condition as desired. Braking the train tends to create slack run-in and accelerating the train tends to create slack run-out. For example, if a transition to the bunched condition is desired, the operator may switch to a lower notch position or apply braking effort at the head end to slow the train at a rate less than its natural acceleration. The natural acceleration is the acceleration of a railcar when no external forces (except gravity) are acting on it. The i th railcar is in a natural acceleration state when neither the i+1 nor the i−1 railcar is exerting any forces on it. The concept is described further below with reference to FIG. 9 and the associated text.

If slack run-in or run-out occurs without operator action, such as when the train is descending a hill, the operator can counter those effects, if desired, by appropriate application of higher tractive effort to counter a run-in or braking effort or lower tractive effort to counter a run-out.

FIG. 5 graphically illustrates limits on the application of tractive effort (accelerating the train) and braking effort (decelerating the train) as a function of a slack state along the continuum of slack conditions between stretched and compressed. As the slack condition tends toward a compressed state, the range of acceptable acceleration forces decreases to avoid imposing excessive forces on the couplers, but acceptable decelerating forces increase. The opposite situation exists as the slack condition tends toward a stretched condition.

Figure 6:
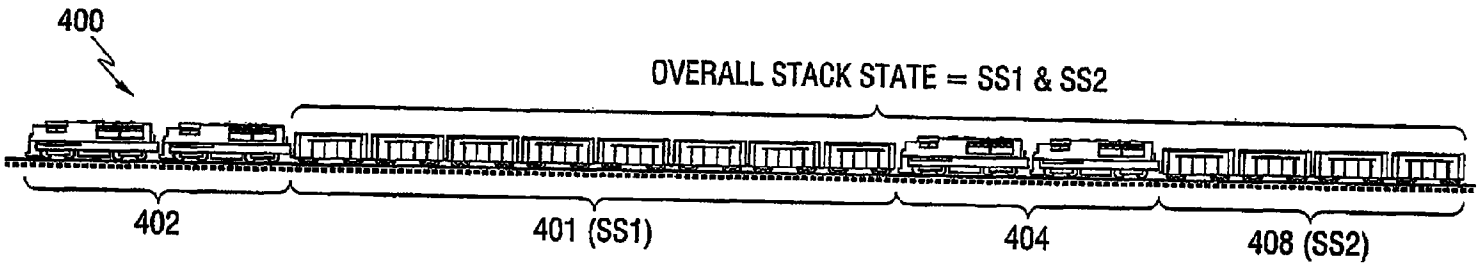
FIG. 6 illustrates multiple slack conditions associated with a railroad train.

FIG. 6 illustrates train segment slack states for a train 400. Railcars 401 immediately behind a locomotive consist 402 are in a first slack state (SS1) and railcars 408 immediately behind a locomotive consist 404 are in a second slack state (SS2). An overall slack state (SS1 and SS2) encompassing the slack states SS1 and SS2 and the slack state of the locomotive consist 404, is also illustrated.

Designation of a discrete slack state as in FIG. 1 or a slack condition on the line 318 of FIG. 2 includes a degree of uncertainty dependent on the methods employed to determine the slack state/condition and practical limitations associated with these methods.

One embodiment of the present invention determines, infers, or predicts the slack condition for the entire train, e.g., substantially stretched, substantially bunched, or in an intermediate slack state, including any number of intermediate discrete states or continuous states. The embodiments of the invention can also determine the slack condition for any segment of the train. The embodiments of the invention also detect (and provide the operator with pertinent information related thereto) a slack run-in (rapid slack condition change from stretched to bunched) and a slack run-out (rapid slack condition change from bunched to stretched), including run-in and run-out situations that may result in train damage. These methodologies are described below.

Responsive to the determined slack condition, the train operator controls train handling to contain in-train forces that can damage the couplers and cause a train break when a coupler fails, while also maximizing train performance. To improve train operating efficiency, the operator can apply a higher deceleration rate when the train is bunched and conversely apply a higher acceleration rate when the train is stretched. However, irrespective of the slack condition, the operator must enforce maximum predetermined acceleration and deceleration limits (relating to the application of tractive effort and the corresponding speed increases and the application of braking effort and the corresponding speed decreases) for proper train handling.

Different embodiments of the present invention comprise different processes and use different parameters and information for determining, inferring, or predicting the slack state/condition, including both a transient slack condition and a steady-state slack condition. The transient slack condition can comprise the rate of change at which slack transition point is moving through the train. The input parameters from which the slack condition can be determined, inferred, or predicted include, but are not limited to, distributed train weight, track profile, track grade, environmental conditions (e.g., rail friction, wind), applied tractive effort, applied braking effort, brake pipe pressure, historical tractive effort, historical braking effort, train speed/acceleration measured at any point along the train, and railcar characteristics. The time rate at which the slack condition is changing (a transient slack condition) or the rate at which the slack condition is moving through the train may also be related to one or more of these parameters.

The slack condition can also be determined, inferred, or predicted from various train operational events, such as the application of sand to the rails, isolation of locomotives, and flange lube locations. Since the slack condition is not necessarily the same for all train railcars at each instant in time, the slack can be determined, inferred, or predicted for individual railcars or for segments of railcars in the train.

Figure 7:
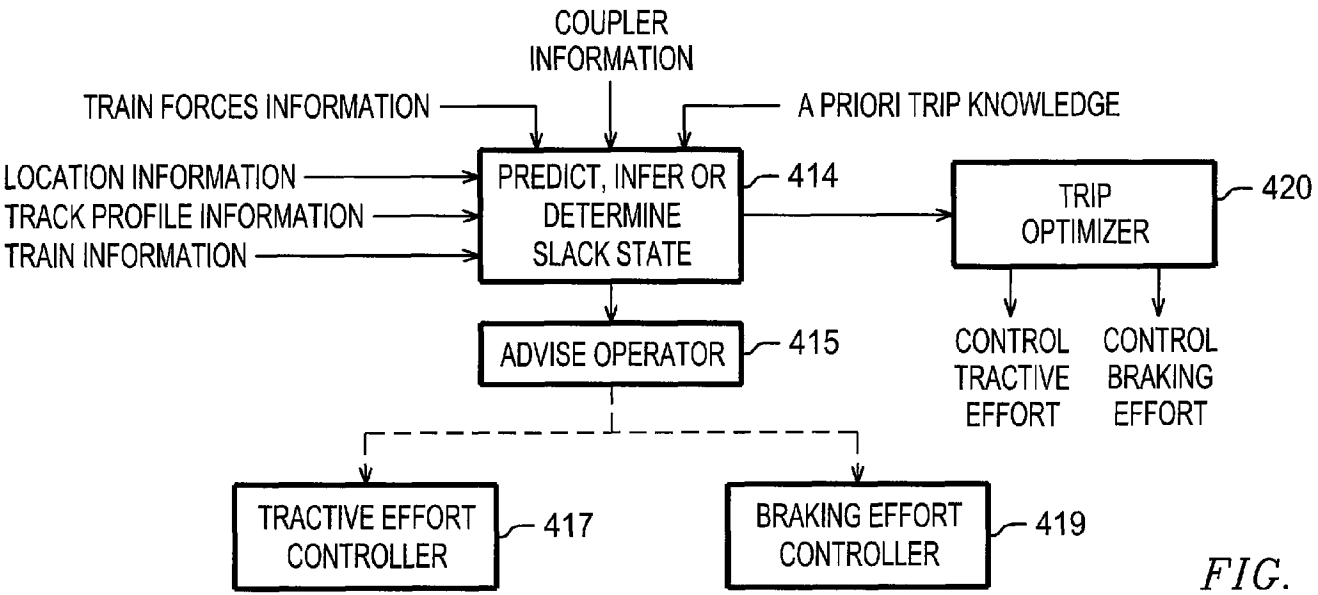
FIG. 7 illustrates a block diagram of a system for determining a slack condition and controlling a train responsive thereto, according to an embodiment of the present invention.

FIG. 7 generally indicates the information and various parameters that can be used according to the embodiments of the present invention to determine, infer, or predict the slack condition, as further described below.

A priori trip information includes a trip plan (e.g., an optimized trip plan) including a speed and/or power (traction effort (TE)/braking effort (BE)) trajectory for a segment of the train's trip over a known track segment. Assuming that the train follows the trip plan, the slack condition can be predicted or inferred at any point along the track to be traversed, either before the trip has begun or while en route, based on the planned upcoming brake and tractive effort applications and the physical characteristics of the train (e.g., mass, mass distribution, resistance forces) and the track.

In one embodiment, the system of the present invention can further display to the operator any situation where poor train handling is expected to occur, such as when rapid slack state transitions are predicted. This display can take numerous forms including distance/time to a next significant slack transition, an annotation on a rolling map, and other forms.

An exemplary application of one embodiment of the invention relates to a train control system that plans a train trip and controls train movement to optimize train performance (based, for example, on determined, predicted, or inferred train characteristics and the track profile), the a priori information can be sufficient for determining the slack condition of the train for the entire train trip. Any human operator-initiated changes from the optimized trip plan may change the slack condition of the train at any given point along the trip.

During a trip that is planned a priori, real time operating parameters may be different than assumed in planning the trip. For example, the wind resistance encountered by the train may be greater than expected or the track friction may be less than assumed. When the trip plan suggests a desired speed trajectory, but the speed varies from the planned trajectory due to these unexpected operating parameters, the operator (including both the human operator manually controlling the train and the automatic train control system) may modify the applied TE/BE to return the train speed to the planned train speed. If the actual train speed tracks the planned speed trajectory then the real time slack condition will remain unchanged from predicted slack condition based on the a priori trip plan.

In an application where the automatic train control system commands application of TE/BE to execute the trip plan, a closed-loop regulator operating in conjunction with the control system receives data indicative of operating parameters, compares the real time parameter with the parameter value assumed in formulating the trip, and, responsive to differences between the assumed parameter and the real time parameter, modifies the TE/BE applications to generate a new trip plan. The slack condition is predetermined based on the new trip plan and operating conditions. Coupler information, including coupler types and the railcar type on which they are mounted, the maximum sustainable coupler forces, and the coupler dead band, may also be used to determine, predict, or infer the slack condition. In particular, this information may be used in determining thresholds for transferring from a first slack state to a second slack state, for determining, predicting, or inferring the confidence level associated with a slack state, for selecting the rate of change of TE/BE applications, and/or for determining acceptable acceleration limits. This information can be obtained from the train make-up or one can initially assume a coupler state and learn the coupler characteristics during the trip as described below.

In another embodiment, the information from which the coupler state is determined can be supplied by the operator via a human machine interface (HMI). The HMI-supplied information can be configured to override any assumed parameters. For example, the operator may know that a particular train/trip/track requires smoother handling than normal due to load and/or coupler requirements and may therefore select a "sensitivity factor" for use in controlling the train. The sensitivity factor is used to modify the threshold limits and the allowable rate of change of TE/BE. Alternately, the operator can specify coupler strength values or other coupler characteristics from which the TE/BE can be determined.

The slack condition at a future time or at a forward track position can be predicted during the trip based on the current state of the train (e.g., slack condition, location, power, speed, and acceleration), train characteristics, the a priori speed trajectory to the forward track location (as will be commanded by the automatic train control system or as determined by the train operator), and the train characteristics. The coupler slack condition at points along the known track segment is predicted assuming tractive and braking efforts are applied according to the trip plan and/or the speed is maintained according to the trip plan. Based on the proposed trip plan, the slack condition determination, prediction, or inference, and the allowed TE/BE application changes, the plan can be modified before the trip begins (or forecasted during the trip) to produce acceptable forces based on the a priori determination.

Train control information, such as the current and historical throttle and brake applications, affect the slack condition and can be used to determine, predict, or infer the current slack state in conjunction with the track profile and the train characteristics. Historical data may also be used to limit the planned force changes at certain locations during the trip.

The distance between locomotive consists in a train can be determined directly from geographical position information for each consist (such as from a GPS location system onboard at least one locomotive per consist or a track-based location system). If the compressed and stretched train lengths are known, the distance between locomotive consists directly indicates the overall (average) slack condition between the consists. For a train with multiple locomotive consists, the overall slack condition for each segment between successive locomotive consists can be determined in this way. If the coupler characteristics (e.g., coupler spring constant and slack) are not known a priori, the overall characteristics can be deduced based on the steady state tractive effort and the distance between consists as a function of time.

The distance between any locomotive consist and the end-of-train device can also be determined, predicted, or inferred from location information (such as from a GPS location system or a track-based location system). If the compressed and stretched train lengths are known, the distance between the locomotive consist and the end-of-train device directly indicates the slack condition. For a train with multiple locomotive consists, multiple slack states can be determined, predicted, or inferred between the end-of-train device and each of the locomotive consists based on the location information. If the coupler characteristics are not known a priori, the overall characteristics can be deduced from the steady state tractive effort and the distance between the lead consist and the end of train device.

Prior and present location information for railcars and locomotives can be used to determine whether the distance between two points in the train has increased or decreased during an interval of interest and thereby indicate whether the slack condition has tended to a stretched or compressed state during the interval. The location information can be determined for the lead or trailing locomotives in a remote or non-lead consist, for remote locomotives in a distributed power train, and for the end-of-train device. A change in slack condition can be determined for any of the train segments bounded by these consists or the end-of-train device.

The current slack condition can also be determined, predicted, or inferred in real time based on the current track profile, current location (including all the railcars), current speed/acceleration, and tractive effort. For example, if the train has been accelerating at a high rate relative to its natural acceleration, then the train is stretched.

If the current slack condition is known and it is desired to attain a specific slack condition at a later time in the trip, the operator can control the tractive and braking effort to attain the desired slack condition.

A current slack action event, i.e., the train is currently experiencing a change in slack condition, such as a transition between compression and stretching (run-in/run-out), can also be detected as it occurs according to the various embodiments of the present invention. In one embodiment, the slack event can be determined regardless of the track profile, current location, and past slack condition. For example, if there is a sudden change in the locomotive/consist speed without corresponding changes in the application of tractive or braking efforts, then it can be assumed that an outside force acted on the locomotive or the locomotive consist causing the slack event.

According to other embodiments, information from other locomotives (including trailing locomotives in a lead locomotive consist and remote locomotives in a distributed power train) provide position/distance information (as described above), speed information, and acceleration information (as described below) to determine, predict, or infer the slack condition. Also, various sensors and devices on the train (such as the end-of-train device) and proximate the track (such as wayside sensors) can be used to provide information from which the slack condition can be determined, predicted, or inferred.

Current and future train forces, either measured or predicted from train operation according to a predetermined trip plan, can be used to determine, predict, or infer the current and future coupler state. The force calculations or predictions can be limited to a plurality of cars in the front of the train where the application of tractive effort or braking effort can create the largest coupler forces due to the momentum of the trailing railcars. The forces can also be used to determine, predict, or infer the current and future slack states for the entire train or for train segments.

Several methods for calculating the coupler forces and/or inferring or predicting the coupler conditions are described below. The force exerted by two linked couplers on each other can be determined from the individual coupler forces and the slack condition determined from the linked coupler forces. Using this technique, the slack condition for the entire train or for train segments can be determined, predicted, or inferred.

Generally, the forces experienced by a railcar are dependent on the forces (traction or braking) exerted by the locomotive at the head end (and by any remote locomotive consists in the train), car mass, car resistance, track profile, and air brake forces. The total force on any railcar is a vector sum of a coupler force in the direction of travel, a coupler force opposite the direction of travel, and a resistance force (a function of the track grade, car velocity, and force exerted by any current air brake application) also opposite the direction of travel.

Further, the rate and direction of coupler force changes indicate changes (transients) in the current slack condition (to a more stretched or to a more bunched state or a transition between states) and indicate a slack event where the train (or segments of the train) switch from a current bunched state to a stretched state or vice versa. The rate of change of the coupler forces and the initial conditions indicate the time at which an impending slack event will occur.

A railcar's coupler forces are functions of the relative motion between coupled railcars in the forward-direction and reverse-direction. The forces on two adjacent railcars indicate the slack condition of the coupler connecting the two railcars. The forces for multiple pairs of adjacent railcars in the train indicate the slack condition throughout the train.

Figure 9:
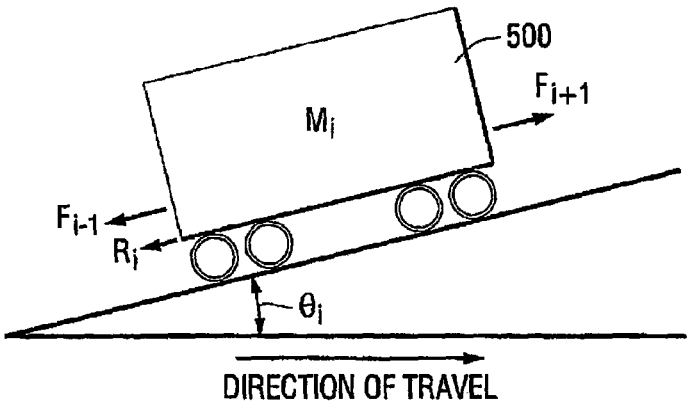
FIG. 9 illustrates forces imposed on a railcar.

A exemplary railcar 500 (the i th railcar of the train) illustrated in FIG. 9 is subject to multiple forces that can be combined to three forces: $F_{i+1}$ (the force exerted by the i+1 railcar), $F_{i-1}$ (the force exerted by the i−1 railcar), and $R_i$ (the resistance of the i th car). The slack condition can be determined, inferred, or predicted from the sign of these forces, and the degree to which the train or a train segment is stretched or bunched can be determined, inferred, or predicted from the magnitude of these forces. The forces are related by the following equations.

$$\Sigma F_i = M_i a_i \tag{1}$$

$$F_{i+1} - F_{i-1} - R_i(\theta_i, v_i) = M_i a_i \tag{2}$$

(Generally speaking, F=force, M=mass, and a=acceleration.) The resistance of the i th car $R_i$ is a function of the grade, railcar velocity, and the braking effort as controlled by the airbrake system. The resistance function can be approximated by:

$$R_i(\theta_i, v_i) = M_i g \sin(\theta_i) + A + Bv_i + Cv_i^2 + \text{airbrake}(BP_i, BP_i', v_i, \ldots) \tag{3}$$

where, $R_i$ is the total resistance force on the i th car, $M_i$ is the mass of the i th car, g is the acceleration of gravity, $\theta_i$ is the angle shown in FIG. 9 for the i th car, $d_i$ is the distance traveled by the i th car, $v_i$ is the velocity of the i th car, A, B, and C are the Davis drag coefficients and BP is the brake pipe pressure (where the three ellipses indicate other parameters that affect the air brake retarding force, e.g., brake pad health, brake efficiency, rail conditions (rail lube, etc.), wheel diameter, brake geometry).

The coupler forces $F_{i+1}$ and $F_{i-1}$ are functions of the relative motion between adjacent railcars as defined by the following two equations.

$$F_{i+1} = f(d_{i,i+1}, v_{i,i+1}, a_{i,i+1}, H.O.T.) \tag{4}$$

$$F_{i-1} = f(d_{i,i-1}, v_{i,i-1}, a_{i,i-1}, H.O.T.) \tag{5}$$

In addition to the distance, velocity, and acceleration terms shown, in another embodiment the functions can include damping effects and other higher order terms (H.O.T.).

According to one embodiment of the present invention, a force estimation methodology is utilized to determine, predict, or infer the train's slack condition from the forces $F_{i+1}$, $F_{i-1}$ and $R_i$. This methodology utilizes the train mass distribution, car length, Davis coefficients, coupler force characteristics, locomotive speed, locomotive tractive effort, and the track profile (curves and grades), wind effects, drag, axle resistance, track condition, etc. as indicated in equations (3), (4) and (5), to model the train and determine coupler forces. Since certain parameters may be estimated and others may be ignored (especially parameters that have a small or negligible effect) in the force calculations, the resulting values are regarded as force estimates within some confidence bound.

Figure 8A:
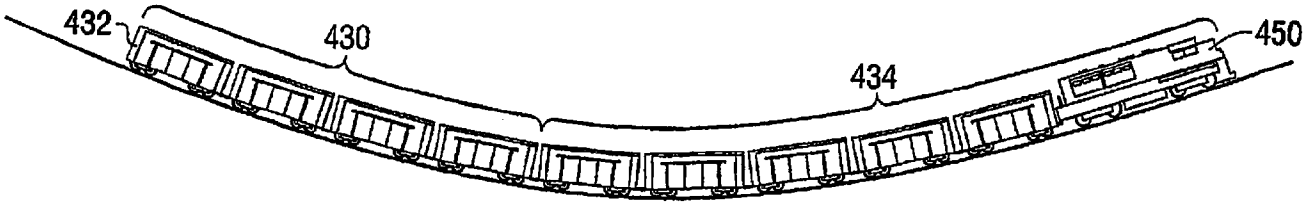
FIGS. 8A and 8B illustrate coupler forces for a railroad train.
Figure 8B:
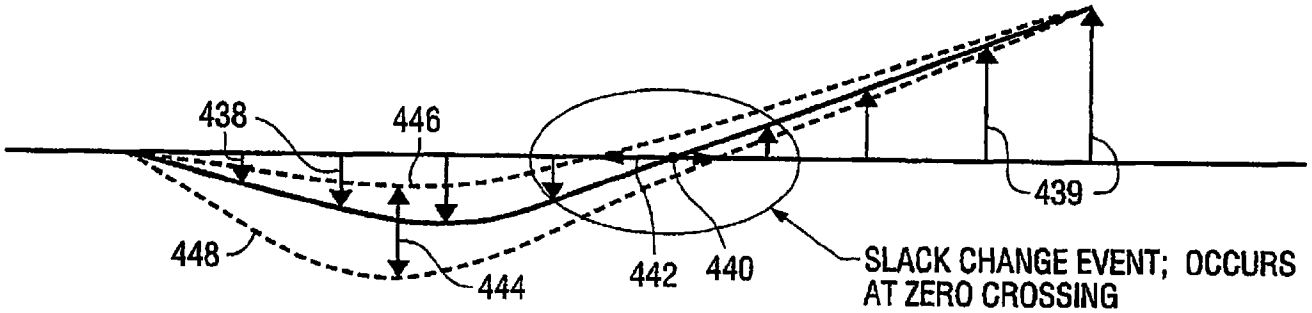

One exemplary illustration of this technique is presented in FIGS. 8A and 8B, where FIG. 8A illustrates a section 430 of a train 432 in a bunched condition and a section 434 in a stretched condition. (The train 432 is moving left to right in FIG. 8A.) An indication of the bunched or stretched condition is presented in the graph of FIG. 8B, where down-pointing arrowheads 438 indicate a bunched state (negative coupler forces) and up-pointing arrowheads 439 indicate a stretched state (positive coupler forces). A slack change event occurs at a zero crossing 440.

A confidence range represented by a double arrowhead 444 and bounded by dotted lines 446 and 448 is a function of the uncertainty of the parameters and methodology used to determine, predict, or infer the slack condition along the train. The confidence associated with the slack transition point 440 is represented by a horizontal arrowhead 442.

The train control system can continuously monitor the acceleration and/or speed of a locomotive consist 450 and compare one or both to a calculated acceleration/speed (according to known parameters such as track grade, TE, drag, speed, etc.) to determine, infer, or predict the accuracy of the known parameters and thereby determine, predict, or infer the degree of uncertainty associated with the coupler forces and the slack condition. The confidence interval can also be based on the change in track profile (for example, track grade), magnitude, and the location of the slack event.

Instead of computing the coupler forces as described above, in another embodiment the sign of the forces imposed on two linked railcars is determined, predicted, or inferred and the slack condition determined therefrom. That is, if the force exerted on a front coupler of a first railcar is positive (i.e., the force is in the direction of travel) and the force exerted on the rear coupler of a second railcar linked to the front of the first railcar is negative (i.e., in the opposite direction to the direction of travel), the slack condition between the two railcars is stretched. When both coupler forces are in the opposite direction as above, the two railcars are bunched. If all the railcars and the locomotives are bunched (stretched) then the train is bunched (stretched). The force estimation technique described above can be used to determine, predict, or infer the signs of the coupler forces.

Both the coupler force magnitudes and the signs of the coupler forces can be used to determine, infer, or predict the current stack state for the entire train or for segments of the train. For example, certain train segments can be in a stretched state where the coupler force F>0, and other segments can be in a compressed state where F<0. The continuous slack condition can also be determined, inferred, or predicted for the entire train or segments of the train based on the relative magnitude of the average coupler forces.

Determining changes in coupler forces (e.g., a rate of change for a single coupler or the change with respect to distance over two or more couplers) can provide useful train control information. The rate of change of force on a single coupler as a function of time indicates an impending slack event. The higher the rate of change the faster the slack condition will propagate along the train (a run-in or a run-out event). The change in coupler force with respect to distance indicates the severity (i.e., magnitude of the coupler forces) of an occurring slack event.

The possibility of an impending slack event, a current slack run-in or run-out event, and/or a severity of the current slack event can be displayed to the operator, with or without an indication of the location of the event. For example, the HMI referred to above can show a slack event in the vicinity of car number "X" (where X=real, whole number) with a severity rating of 7. This slack event information can also be displayed in a graphical format as shown in FIG. 4. This graphical indication of a slack event can be represented using absolute distance, car number, relative (percent) distance, absolute tonnage from some reference point (such as the locomotive consist), or relative (percent) tonnage, and can formatted according to the severity and/or trend (color indication, flashing, etc.).

Furthermore, additional information about the trend of a current slack event can be displayed to inform the operator if the situation is improving or degrading. The system can also predict, with some confidence bound as above, the effect of increasing or decreasing the current notch command. Thus, the operator is given an indication of the trend to be expected if certain notch change action is taken.

The location of slack events, the location trend, and the magnitude of coupler forces can also be determined, predicted, or inferred by the force estimation method. For a single consist train, the significance of a slack event declines in a direction toward the back of the train because the total car mass declines rearward of the slack event and thus the effects of the slack event are reduced. However, for a train including multiple consists (e.g., lead and non-lead consists), the significance of the slack event at a specific train location declines as the absolute distance to the slack event increases. For example, if a remote consist is in the center of the train, slack events near the front and center are significant slack events relative to the centered remote consist, but slack events three-quarters of the distance to the back of the train and at the end of train are not as significant. The significance of the slack event can be a function solely of distance, or in another embodiment the determination incorporates the train weight distribution by analyzing instead the mass between the consist and the slack event, or a ratio of the mass between the consist and the slack event and the total train mass. The trend of this tonnage can also be used to characterize the current state.

The coupler force signs can also be determined, predicted, or inferred by determining the lead locomotive acceleration and the natural acceleration of the train, as further described below.

The coupler force functions set forth in equations (4) and (5) are only piecewise continuous as each includes a dead zone or dead band where the force is zero when the railcars immediately adjacent to the railcars of interest are not exerting any forces on the car of interest. That is, there are no forces transmitted to the i th car by the rest of the train, specifically by the (i+1)th and the (i−1)th railcars. In the dead band region the natural acceleration of the car can be determined, predicted, or inferred from the car resistance and the car mass since the railcar is independently rolling on the track. This natural acceleration methodology for determining, predicting, or inferring the slack condition avoids calculating the coupler forces as in the force estimation method above. The pertinent equations are $$-R_i(\theta_i, v_i) = M_i a_i \tag{6}$$

$$a_i = \frac{-R_i(\theta_i, v_i)}{M_i} \tag{7}$$

where it is noted by comparing equations (2) and (6) that the force terms $F_{i+1}$, $F_{i-1}$ are absent since the i+1 and the i−1 railcars are not exerting any force on the i th car. The value $a_i$ is the natural acceleration of the i th railcar.

If all the couplers on the train are either stretched, $F_{i+1}$, $F_{i-1}>0$ (the forward and reverse direction forces on any car are greater than zero) or bunched, $F_{i+1}$, $F_{i-1}<0$ (the forward and reverse direction forces on any car are less than zero) then the velocity of all the railcars is substantially the same and the acceleration (defined positive in the direction of travel) of all railcars (denoted the common acceleration) is also substantially the same. If the train is stretched, positive acceleration above the natural acceleration maintains the train in the stretched state. (However negative acceleration does not necessarily mean that the train is not stretched.) Therefore, the train will stay in the stretched (bunched) condition only if the common acceleration is higher (lower) than the natural acceleration at any instant in time for all the individual railcars following the consist where the common acceleration is measured. If the train is simply rolling, the application of TE by the lead consist causes a stretched slack condition if the experienced acceleration is greater than the train's maximum natural acceleration (where the train's natural acceleration is the largest natural acceleration value from among the natural acceleration value of each railcar). As expressed in equation form, where a is the common acceleration, the conditions for fully stretched and fully bunched slack state, respectively, are:

$$a > a_i = \frac{-R_i(\theta_i, v)}{M_i}, \forall i \tag{8}$$

$$a < a_i = \frac{-R_i(\theta_i, v)}{M_i}, \forall i \tag{9}$$

To determine, predict, or infer the common acceleration, the acceleration of the lead locomotive is determined and it is inferred that the lead acceleration is substantially equivalent to the acceleration of all the railcars in the train. Thus the lead unit acceleration is the common acceleration. To determine, predict, or infer the slack condition at any instant in time, one determines the relationship between the inferred common acceleration and the maximum and minimum natural acceleration from among all of the railcars, recognizing that each car has a different natural acceleration at each instant in time. The equations below determine $a_{max}$ (the largest of the natural acceleration values from among all railcars of the train) and $a_{min}$ (the smallest of the natural acceleration values from among all railcars of the train).

$$a_{max} = \mathrm{Max}\left(\frac{-R_i(\theta_i, v)}{M_i}\right) \tag{10}$$

$$a_{min} = \mathrm{Min}\left(\frac{-R_i(\theta_i, v)}{M_i}\right) \tag{11}$$

If the lead unit acceleration (common acceleration) is greater than $a_{max}$ then the train is stretched and if the lead unit acceleration is less than $a_{min}$ then the train is bunched.

Figure 10:
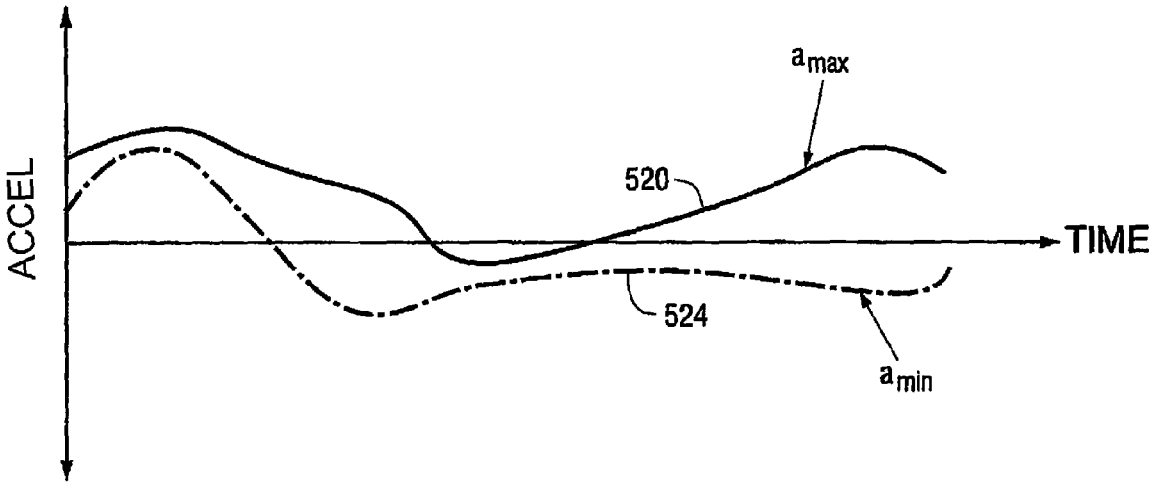
FIG. 10 graphically illustrates minimum and maximum natural railcar accelerations for a railroad train as a function of time.

FIG. 10 illustrates the results from equations (10) and (11) as a function of time, including a curve 520 indicating the maximum natural acceleration from among all the railcars as a function of time and a curve 524 depicting the minimum natural acceleration from among all the railcars as a function of time. The common acceleration of the train, as inferred from the locomotive's acceleration, would be overlaid on the FIG. 10 graph. At any time when the common acceleration exceeds the curve 520 the train is in the stretched state. At any time when the common acceleration is less than the curve 524 then the train is in the bunched state. A common acceleration between the curves 520 and 524 indicates an indeterminate state such as the intermediate state 302 of FIG. 1. As applied to a continuous slack condition model as depicted in FIG. 2, the difference between the common acceleration and the corresponding time point on the curves 520 and 524 determines a percent of stretched or a percent of bunched slack state condition.

The minimum and maximum natural accelerations are useful to an operator, even for a train controlled by an automatic train control system, as they represent the accelerations to be attained at that instant to ensure a stretched or bunched state. These accelerations can be displayed as simply numerical values (e.g., x MPH/min) or graphically as a "bouncing ball," as a plot of the natural accelerations, a plot of minimum and maximum natural accelerations along the track for a period of time ahead, and according to other display depictions, to inform the operator of the stretched (maximum) and bunched (minimum) accelerations.

The plots of FIG. 10 can be generated before the trip begins (if a trip plan has been prepared prior to departure) and the common acceleration of the train (as controlled by the operator or the automatic train control system) used to determine, infer, or predict whether the train will be stretched or bunched at a specific location on the track. Similarly, they can be computed and compared en route and updated as deviations from the plan occur.

A confidence range can also be assigned to each of the $a_{max}$ and $a_{min}$ curves of FIG. 8 based on the confidence that the parameters used to determine the natural acceleration of each railcar accurately reflect the actual value of that parameter at any point during the train trip.

When the train's common acceleration is indicated on the FIG. 10 graph, a complete slack transition occurs when common acceleration plot moves from above the curve 520 to below the curve 524, i.e., when the slack condition changes from completely stretched to completely bunched. It is known that a finite time is required for all couplers to change their slack condition (run-in or run-out) after such a transition. It may therefore be desired to delay declaration of a change in slack condition following such a transition to allow all couplers to change state, after which the train is controlled according to the new slack condition.

To predict the slack condition/state, when a train speed profile is known (either a priori based on a planned speed profile or measured in real time) over a given track segment, predicted (or real-time) acceleration is compared to the instantaneous maximum natural acceleration for each railcar at a distance along the track. The instantaneous slack condition can be determined, predicted, or inferred when the predicted/actual acceleration differs (in the right direction) from the maximum or the minimum natural accelerations, as defined in equations (10) and (11) above, by more than a predetermined constant. This difference is determined, predicted, or inferred as a fixed amount or a percentage as in equations (12) and (13) below. Alternatively, the slack condition is determined, predicted or inferred over a time interval by integrating the difference over the time interval as in equations (14) and (15) below.

$$a_{min} - a_{predicted} > k_1 \tag{12}$$

$$a_{predicted} - a_{max} > k_1 \tag{13}$$

$$\int (a_{min} - a_{predicted})dt > k_2 \tag{14}$$

$$\int (a_{predicted} - a_{max})dt > k_2 \tag{15}$$

where $k_1$ and $k_2$ are predetermined constants. The slack condition can also be predicted at some time in the future if the current slack condition, the predicted applied tractive effort (and hence the acceleration), the current speed, and the upcoming track profile for the track segment of interest are known.

Knowing the predicted slack condition according to either of the described methods may affect the operator's control of the train such that upcoming slack changes that may cause coupler damage are prevented.

In another embodiment, with knowledge of the current speed (acceleration), past speed, and past slack condition, the current or real-time slack condition is determined, predicted, or inferred from the train's current track location (track profile) by comparing the actual acceleration (assuming all cars in the train have the same common acceleration) with the minimum and maximum natural accelerations from equations (16) and (17). Knowing the current slack condition allows the operator to control the train in real-time to avoid coupler damage.

$$a_{min} - a_{actual} > k_1 \tag{16}$$

$$a_{actual} - a_{max} > k_1 \tag{17}$$

$$\int (a_{min} - a_{actual})dt > k_2 \tag{18}$$

$$\int (a_{actual} - a_{max})dt > k_2 \tag{19}$$

Also note that $a_{min}$ and $a_{max}$ can be determined, predicted, or inferred for any segment of the train used to define multiple slack states as described elsewhere herein. Furthermore, the location of $a_{min}$ and $a_{max}$ in the train can be used to quantify the intermediate slack condition and to assign the control limits.

When the slack condition of the train is known, for example as determined, predicted, or inferred according to the processes described herein, the train is controlled (automatically or manually) responsive thereto. Tractive effort can be applied at a higher rate when the train is stretched without damage to the couplers. In an embodiment in which a continuous slack condition is determined, predicted, or inferred, the rate at which additional tractive effort is applied is responsive to the extent to which the train is stretched. For example, if the common acceleration is 50% of the maximum natural acceleration, the train can be considered to be in a 50% stretched condition and additional tractive effort can be applied at 50% of the rate at which it would be applied when the common acceleration is greater than the maximum acceleration, i.e., a 100% stretched condition. The confidence is determined by comparing the actual experienced acceleration given TE/speed/location with the calculated natural acceleration as described above.

In a distributed power train (DP train), one or more remote locomotives (or a group of locomotives in a locomotive consist) are remotely controlled from a lead locomotive (or a lead locomotive consist) via a hard-wired or radio communications link. One such radio-based DP communications system is commercially available under the trade designation Locotrol® from the General Electric Company of Fairfield, Conn. and is described in GE's U.S. Pat. No. 4,582,280. Typically, a DP train comprises a lead locomotive consist followed by a first plurality of railcars followed by a non-lead locomotive consist followed by a second plurality of railcars. Alternatively, in a pusher operating mode the non-lead locomotive consist comprises a locomotive consist at the end-of-train position for providing tractive effort as the train ascends a grade.

Figure 11:
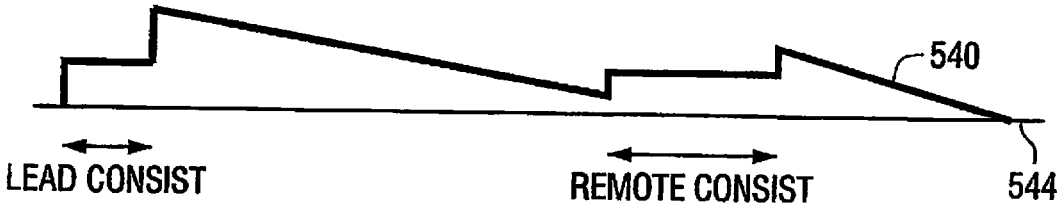
FIGS. 11 and 12 graphically illustrate slack conditions for a distributed power train.

The natural acceleration method described above can be used to determine the slack condition in a DP train. FIG. 11 shows an exemplary slack condition in a DP train. In this case all couplers are in tension (a coupler force line 540 is depicted above a zero line 544, indicating a stretched state for all the railcars couplers). The acceleration as measured at either of the locomotive consists (the head end or lead consist or the remote non-lead consist) is higher than the natural acceleration of any one railcar or blocks of railcars in the entire train, resulting in a stable train control situation.

Figure 12:
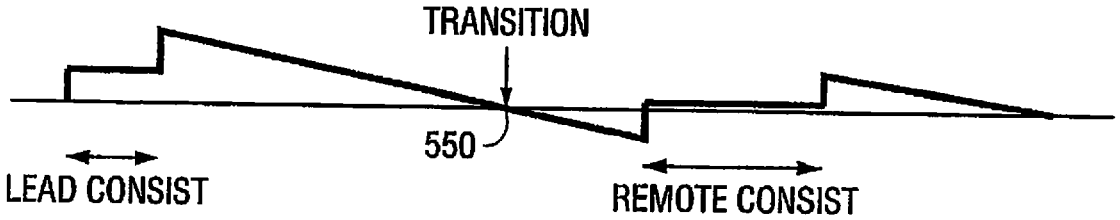

However, a "fully stretched" situation may also exist when the remote locomotive consist is bearing more than just the railcars behind it. FIG. 12 illustrates this scenario. Although all coupler forces are not positive, the acceleration of both locomotive consists is higher than the natural acceleration of the railcars. This is a stable scenario as every railcar is experiencing a net positive force from one locomotive consist or the other. A transition point 550 is a zero force point—often called the "node," where the train effectively becomes two trains with the lead locomotive consist seeing the mass of the train from the head end to the transition point 550 and the remote locomotive consist seeing the remaining mass to the end of the train. This transition point can be nominally determined if the lead and remote locomotive consist acceleration, tractive effort, and the track grade are known. If the acceleration is unknown, it can be assumed that the system is presently stable (i.e., the slack condition is not changing) and that the lead and remote locomotive consist accelerations are identical.

In this way, multiple slack states along the train (that is, for different railcar groups or sub-trains) can be identified and the train controlled responsive to the most restrictive sub-state in the train (i.e., the least stable slack state associated with one of the sub-trains) to stabilize the least restrictive state. Such control may be exercised by application of tractive effort or braking effort by the locomotive consist forward of the sub-train having the less stable state or the locomotive consist forward of the sub-train having the more stable state.

Alternatively, a combination of the two states can be used to control the train depending on the fraction of the mass (or another train/sub-train characteristic such as length) in each sub-train. The above methods can be employed to further determine these sub-states within the train and similar strategies for train control can be implemented. The determined states of the train and sub-trains can also be displayed for the operator's use in determining train control actions. In an application to an automatic train control system, the determined states are input to the train control system for use in determining train control actions for the train and the sub-trains.

When given the option of changing power levels (or braking levels) at one of the consists, responsive to a need to change the train's tractive (or braking) effort, preference should be given to the consist connected to the train section (sub-train) having the most stable slack condition. It is assumed in this situation that all other constraints on train operation, such as load balancing, are maintained.

When a total power level change is not currently required, the power can be shifted from one consist to the other for load balancing. Typically the shift involves a tractive effort shift from the consist controlling the most stable sub-train to the consist controlling the least stable sub-train, depending on the power margin available. The amount of power shifted from one consist to the other may be accomplished by calculating the average track grade or equivalent grade taking into account the weight or weight distribution of the two or more subtrains and distributing the applied power responsive to the ratio of the weight or weight distribution. Alternatively, the power can be shifted from the consist connected to the most stable sub-train to the consist connected to the least stable sub-train as long as the stability of the former is not comprised.

In addition to the aforementioned control strategies, it is desired to control the motion of the transition point 550 in the train. As this point moves forward or backward in the train, localized transient forces are present as this point moves from one railcar to an adjacent railcar. If this motion is rapid, these forces can become excessive and can cause railcar and coupler damage. The tractive effort of either consist can be controlled such that this point moves no faster than a predetermined maximum speed. Similarly, the speed of each consist can be controlled such that the distance between the lead and the remote locomotive consists does not change rapidly.

In addition to the above mentioned algorithms and strategies, in another embodiment, instead of analyzing an individual railcar and making an assessment of the train state and associated allowable control actions, similar results may be derived by looking at only portions of the train or the train in its entirety.

For example, the above natural acceleration method may be restricted to looking at the average grade over several railcar lengths and using that data with the sum drag to determine a natural acceleration for this block of cars. This embodiment reduces computational complexity while maintaining the basic conceptual intent.

Although various techniques for predicting the slack condition have been described herein, certain ones of the variables that contribute to the prediction are continually in flux, such as Davis drag coefficients, track grade database error, rail/bearing friction, airbrake force, etc. To overcome the effects of these variations, another embodiment of the invention monitors axle jerk (i.e., the rate of change of the acceleration) to detect a slack run-in (rapid slack condition change from stretched to bunched) and a slack run-out (rapid slack condition change from bunched to stretched). The run-in/run-out occurs when an abrupt external force acts on the lead consist, resulting in a high rate of change of the acceleration in time.

This reactive method of one embodiment determines, predicts, or infers a change in the slack condition by determining the rate of change of one or more locomotive axle accelerations (as noted above, this is referred to as "jerk," which is a derivative of acceleration with time) compared with an applied axle torque. Slack action is indicated when the measured jerk is inconsistent with changes in applied torque due to the application of TE or BE, e.g., the actual jerk exceeds the expected jerk by some threshold. The sign of the jerk (denoting a positive or a negative change in acceleration as a function of time) is indicative of the type of slack event, e.g, a run-in or a run-out. If the current slack condition is known (or had been predicted) then the new slack condition caused by the jerk can be determined.

The system of one embodiment monitors jerk and establishes acceptable upper and lower limits based on the train characteristics, such as mass (including the total mass and the mass distribution), length, consist, power level, track grade, etc. The upper and lower limits change with time as the train characteristics and track conditions change. Any measured time derivative of acceleration (jerk) beyond these limits indicates a run-in or run-out condition and can be flagged or indicated accordingly for use by the operator (or an automatic train control system) to properly control the train.

If the train is not experiencing an overspeed condition when the jerk is detected, in one embodiment the train is controlled to hold current power or tractive effort output for some period of time or travel distance to allow the train to stabilize without further perturbations. Another operational option is to limit the added power application rate to a planned power application rate. For example, if an advisory control system is controlling the locomotive and executing to an established plan speed and plan power, the system continues to follow the planned power but is precluded from rapidly compensating to maintain the planned speed during this time. The intent is therefore to maintain the macro-level control plan without unduly exciting the system. However, should an overspeed condition occur at any time, it will take precedence over the hold power strategy to limit the run-in/out effects.

Figure 13:
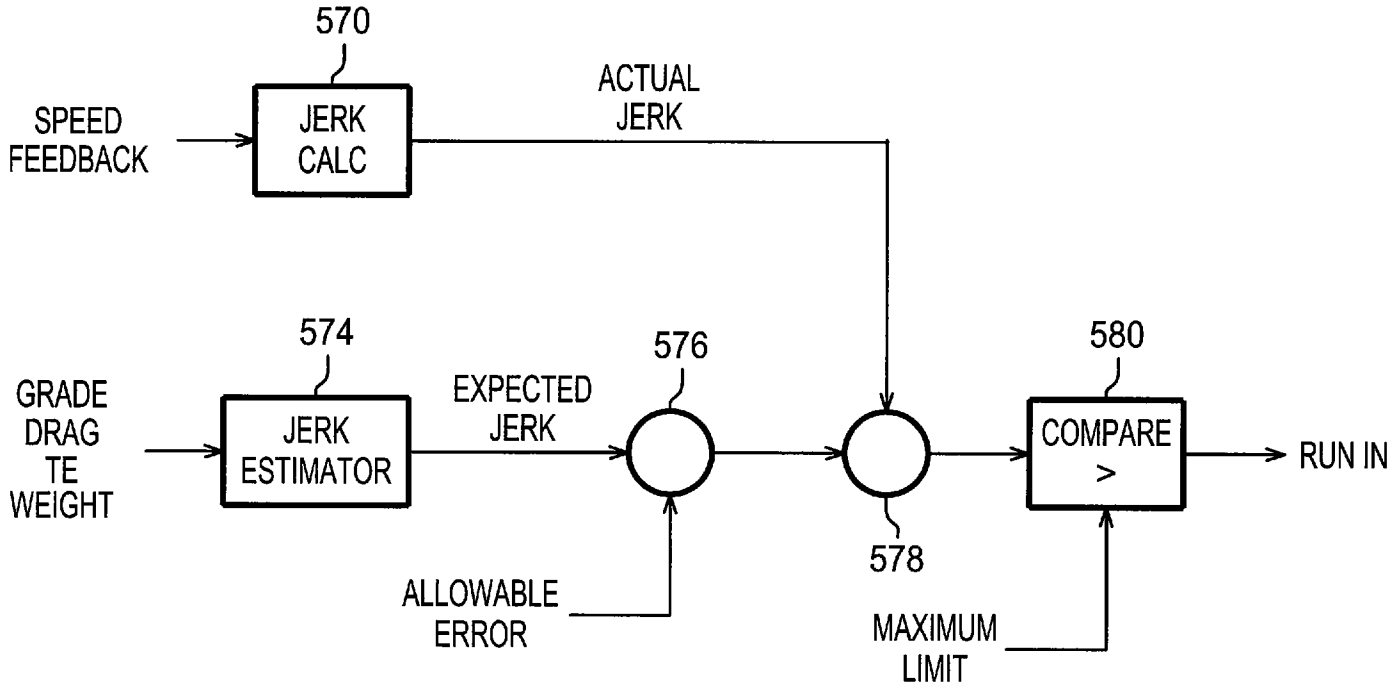
FIG. 13 illustrates a block diagram of elements for determining a reactive jerk condition.

FIG. 13 illustrates one embodiment for determining a run-in condition. Similar functional elements are employed to determine a run-out condition. Train speed information is input to a jerk calculator 570 for determining a rate of change of acceleration (or jerk) actually being experienced by a vehicle in any train segment.

Train movement and characteristic parameters are input to a jerk estimator 574 for producing a value representative of an expected jerk condition similar to the actual jerk being calculated in 570. A summer 576 combines the value from the estimator 574 with an allowable error value. The allowable error depends on the train parameters and the confidence of the estimation of expected jerk. The output of the summer 576 represents the maximum expected jerk at that time. Element 578 calculates the difference between this maximum expected jerk and the actual jerk being experienced as calculated by the jerk calculator element 570. The output of this element represents the difference/error between the actual and the maximum expected jerk.

A comparator 580 compares this difference with the maximum limit of allowed jerk error. The maximum limit allowed can also depend on the train parameters. If the difference in jerk is greater than the maximum allowed limit, a run-in condition is declared. Comparator 580 can also include a time persistence function. In this case the condition has to persist for a predetermined period of time (example 0.5 second) to determine a run in condition. Instead of rate of change of acceleration being compared, the actual acceleration could be used to compare as well. Another method includes the comparison of a detector like accelerometer or a strain gauge on the coupler or platform with the expected value calculated in a similar manner. A similar function is used for run out detection.

In a train including multiple (lead and trailing) locomotives in the lead consist, the information from the trailing locomotives can be used advantageously to detect slack events. Monitoring the axle jerk (as described above) at the trailing locomotive in the consist allows detection of slack events where the coupler forces are highest and thus the slack action most easily detectable.

Also, knowing the total consist tractive or braking effort improves the accuracy of all force calculations, parameter estimations, etc. in the equations and methodologies set forth herein. Slack action within the locomotive consist can be detected by determining, predicting, or inferring differences in acceleration between the consist locomotives. The multiple axles in a multiple consist train (a distributed power train) also provide additional points to measure the axle jerk from which the slack condition can be determined.

Figure 14:
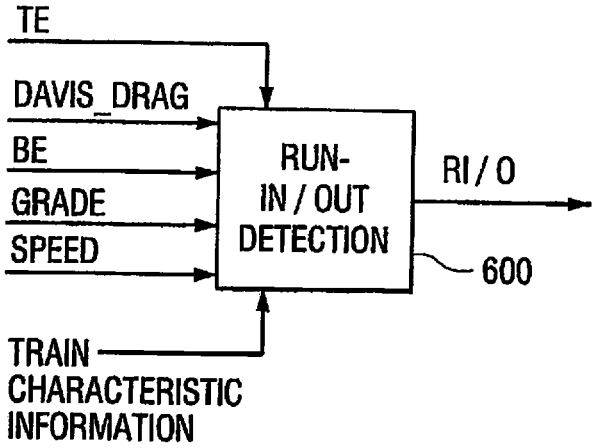
FIG. 14 illustrates the parameters employed to detect slack conditions, including a run-in or run-out condition.

FIG. 14 illustrates a slack condition detector or run-in/run-out detector 600 receiving various train operating and characteristic (e.g., static) parameters from which the slack condition (including a run-in or a run-out condition) is determined. Various described embodiments employ different algorithms, processes, and input parameters to determine the slack condition as described herein.

In a train having multiple locomotive consists (such as a distributed power train), slack condition information can be determined, predicted, or inferred from a difference between the speed of any two of the consists over time. The slack condition between two locomotive consists can be determined, predicted, or inferred from the following equation, wherein v represents velocity:

$$\int(v_{consist_1}-v_{consist_2})dt \tag{20}$$

Changes in this distance (resulting from changes in the relative speed of the consists) indicate changes in the slack condition. If the speed difference is substantially zero, then the slack condition remains unchanged. If the coupler characteristics are not known a priori, they can be determined, predicted, or inferred based on the steady state tractive effort and distance between locomotive consists.

If the distance between the two consists is increasing, the train is moving toward a stretched condition. Conversely, if the distance is decreasing the train is moving toward a bunched condition. Knowledge of the slack condition before calculating the value in equation (20) indicates a slack condition change.

For a train with multiple locomotive consists, the slack condition can be determined, predicted, or inferred for train segments (referred to as sub trains, and including the trailing railcars at the end of the train) that are bounded by a locomotive consist, since it is known that different sections of the train may experience different slack conditions.

For a train having an end-of-train (EOT) device, the relative speed between the end-of-train device and the lead locomotive (or between the end of train device and any of the remote locomotive consists) determines the distance between therebetween according to the equation $$\int(v_{consist}-v_{EOT})dt \tag{21}$$

Changes in this distance indicate changes in the slack condition.

In another embodiment, the grade the train is traversing can be determined to indicate the train slack condition. Further, the current acceleration, drag, and other external forces that affect the slack condition can be converted into an equivalent grade parameter, and the slack condition determined from that parameter. For example, while a train is traversing flat, tangent track, a force due to drag resistance is still present. This drag force can be considered as an effective positive grade without a drag force. It is desired to combine all the external forces on each car (e.g., drag, acceleration) (i.e., except forces due to the track configuration where such track configuration forces are due to track grade, track profile, track curves, etc.), such into a single "effective grade" (or equivalent grade) force. Summing the effective grade and the actual grade determines the net effect on the train state. Integrating the equivalent grade from the rear of the train to the front of the train as a function of distance can determine where slack will develop by observing any points close to or crossing over zero. This qualitative assessment of the slack forces may be a sufficient basis for indicating where slack action can be expected. The equivalent grade can also be modified to account for other irregularities such as non-uniform train weight.

Once the slack condition is known, estimated, or known to be within certain bounds (either a discrete state of FIG. 1 or a slack condition on the line 318 of FIG. 2), according to the various techniques described herein, information representing the slack condition (e.g., a numerical value, qualitative indication, or a range of values) is supplied to the operator (including an automatic train control system). Based on this information, the operator generates commands that control train speed or that apply tractive effort or braking effort at each locomotive or within a locomotive consist to ensure that excessive coupler forces are not generated. See FIG. 7, where a block 414 indicates the control system predicting, inferring, or determining a slack state or condition. Block 415 indicates that the operator is advised of the slack condition for operating (as indicated by the dashed lines) the tractive effort controller 417 or the braking effort controller 419 responsive thereto. Any of the various display formats described herein can be used to provide the information. In a train operated by an automotive train control system, the block 415 represents the automatic train control system. Block 420 indicates that slack condition information may also or alternatively be supplied to a Trip Optimizer™ system for use in planning or re-planning a trip plan.

In addition to controlling the TE and BE, the slew rates for tractive effort changes and braking effort changes, and dwell times for tractive effort notch positions and for brake applications, can also controlled according to the slack condition. Limits on these parameters can be displayed to the operator as suggested handling practices given the current slack condition of the train. For example, if the operator had recently changed notch, the system could display a "Hold Notch" recommendation for x seconds, responsive to the current slack condition. The specified period of time would correspond to the recommended slew rate based on the current slack condition. Similarly, the system can display the recommended acceleration limits for the current train slack condition and notify the operator when these limits are exceeded.

The operator or the automatic train control system can also control the train to achieve desired slack conditions (as a function of track condition and location) by learning from past operator behavior. For example, the locomotive can be controlled by the application of proper tractive effort and/or braking effort to keep the train in a stretched or bunched condition at a track location where a certain slack condition is desired. Conversely, application of dynamic brakes among all locomotives in the train or independent dynamic brake application among some locomotives can gather the slack at certain locations. These locations can be marked in a track database.

In yet another embodiment, prior train operations over a track network segment can be used to determine train handling difficulties encountered during the trip. This resulting information is stored in a database for later use by trains traversing the same segment, allowing these later trains to control the application of TE and BE to avoid train handling difficulties.

The train control system can permit operator input of a desired slack condition or coupler characteristics (e.g., stiff couplers) and generate a trip plan to achieve the desired slack condition. Manual operator actions can also achieve the desired slack condition according to any of the techniques described above.

Input data for use in the coupler slack and train handling algorithms and equations described above (which can be executed either on the train or at a dispatch center) can be provided by a manual data transfer from off-board equipment such as from a local, regional, or global dispatch center to the train for on-board implementation. If the algorithms are executed in wayside equipment, the necessary data can be transferred thereto by passing trains or via a dispatch center.

The data transfer can also be performed automatically using off-board, on-board or wayside computer and data transfer equipment. Any combination of manual data transfer and automatic data transfer with computer implementation anywhere in the rail network can be accommodated according to the embodiments of the present invention described herein.

The algorithms and techniques described herein for determining the slack condition can be provided as inputs to a trip optimization algorithm to prepare an optimized trip plan that considers the slack conditions and minimizes in-train forces. (See 420 in FIG. 7.) The algorithms can also be used to post-process a plan (regardless of its optimality), or they can be executed in real time.

The various embodiments of the invention employ different devices for determining or measuring train characteristics (e.g., relatively constant train make-up parameters such as mass, mass distribution, length) and train movement parameters (e.g., speed, acceleration) from which the slack condition can be determined as described. Such devices can include, for example, one or more of the following: sensors (e.g., for determining force, separation distance, track profile, location, speed, acceleration, TE, and BE), manually input data (e.g., weight data as manually input by the operator), and predicted information.

Although certain techniques and mathematical equations are set forth herein for determining, predicting, and/or inferring parameters related to the slack condition of the train and train segments, and determining, predicting, or inferring the slack condition therefrom, the embodiments of the invention are not limited to the disclosed techniques and equations, but instead encompass other techniques and equations known to those skilled in the art.

One skilled in the art recognizes that simplifications and reductions may be possible in representing train parameters, such as grade, drag, etc. and in implementing the equations set forth herein. Thus the embodiments of the invention are not limited to the disclosed techniques, but also encompass simplifications and reductions for the data parameters and equations.

The embodiments of the present invention contemplate multiple options for the host processor computing the slack information, including processing the algorithm on the locomotive of the train, within wayside equipment, off-board (in a dispatch-centric model), or at another location on the rail network. Execution can be prescheduled, processed in real time, or driven by a designated event such as a change in train or locomotive operating parameters, that is, operating parameters related to either the train of interest or other trains that may be intercepted by the train of interest.

The methods and apparatus of the invention embodiments provide coupler condition information for use in controlling the train. Since the techniques of the invention embodiments are scalable, they can provide an immediate rail network benefit even if not implemented throughout the network. Local tradeoffs can also be considered without the necessity of considering the entire network.

As illustrated in the exemplary embodiment of FIGS. 15-18, a system 1000 includes a train 1001 having a lead locomotive consist and a trail locomotive consist in a 2×1 arrangement. The 2×1 arrangement of the train 1001 includes two lead locomotives 1006,1008 positioned in the lead locomotive consist at the front of the train 1001, and one trail locomotive 1009 positioned in the trail locomotive consist at the rear of the train 1001. For purposes of this disclosure, "locomotive consist" refers to a group of locomotives within the train 1001, such as the lead locomotives 1006,1008 which form the lead locomotive consist, for example, or the trail locomotive 1009, which forms the trail locomotive consist, for example. Using the same 2×1 symbols to depict the number of lead locomotives and trail locomotives, a 4×2 arrangement may be provided, which would feature four lead locomotives and two trail locomotives, for example. Additionally, although the embodiments of the present invention discussed in FIGS. 15-18 involve a 2×1 arrangement of a locomotive consist, the present invention may be employed with a locomotive consist having an arrangement other than a 2×1 arrangement, such as where the locomotives are positioned at various locations throughout the train, for example. The exemplary embodiment of FIGS. 15-18 features a synchronous arrangement, in which two thirds of the net power required to move the train 1001 is provided by the two lead locomotives 1006,1008, and one third of the net power required to move the train 1001 is provided by the trail locomotive 1009 (so as to make the explanation easier). The exemplary embodiment of FIGS. 15-18 additionally assumes that the train 1001 will maintain a steady speed condition, that an even distribution of weight is present across an exemplary 150-car train 1001, and that the train 1001 travels over a uniformly graded hill 1010. Although the embodiments of FIGS. 15-26 involve a 150-car train 1001 traveling over a uniformly graded hill 1010 (for ease of explaining the concept), the embodiments of the present invention are generally applicable to a locomotive consist of any length, traveling over any type of graded terrain, as discussed in the algorithm below. Similarly, if the trail locomotive 1009 had a greater maximum horsepower rating than the lead locomotives 1006,1008, then the synchronous operation would not be possible, as the notch setting of each locomotive would be different upon assigning one third of the net power to the trail locomotive 1009 and two thirds of the net power to the lead locomotive 1006,1008, and the trail locomotive 1009 would have a lower notch setting, for example.

Figure 15:
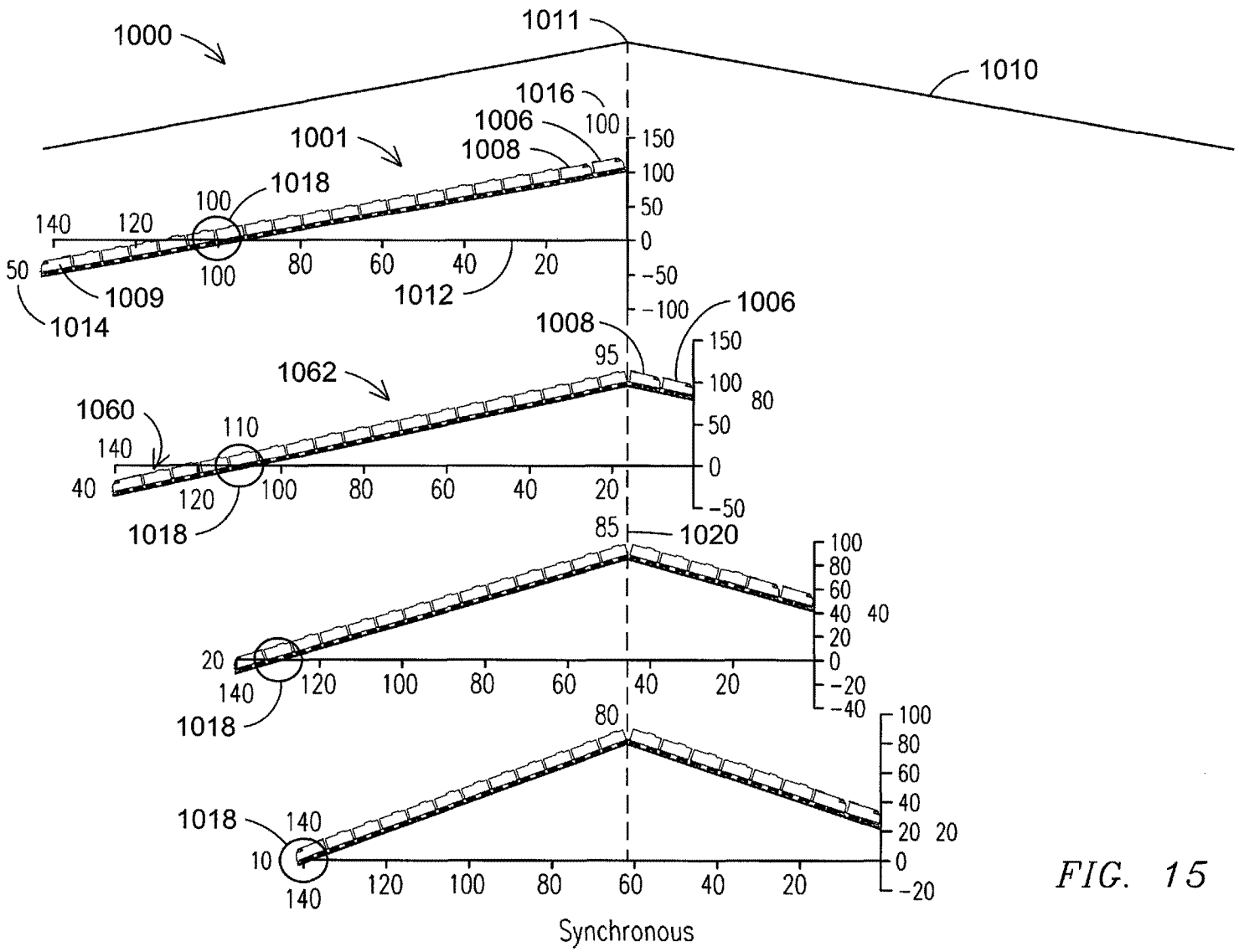
FIG. 15 illustrates a schematic diagram of a synchronous locomotive consist configured to pass over a hill having a uniform grade.
Figure 16:
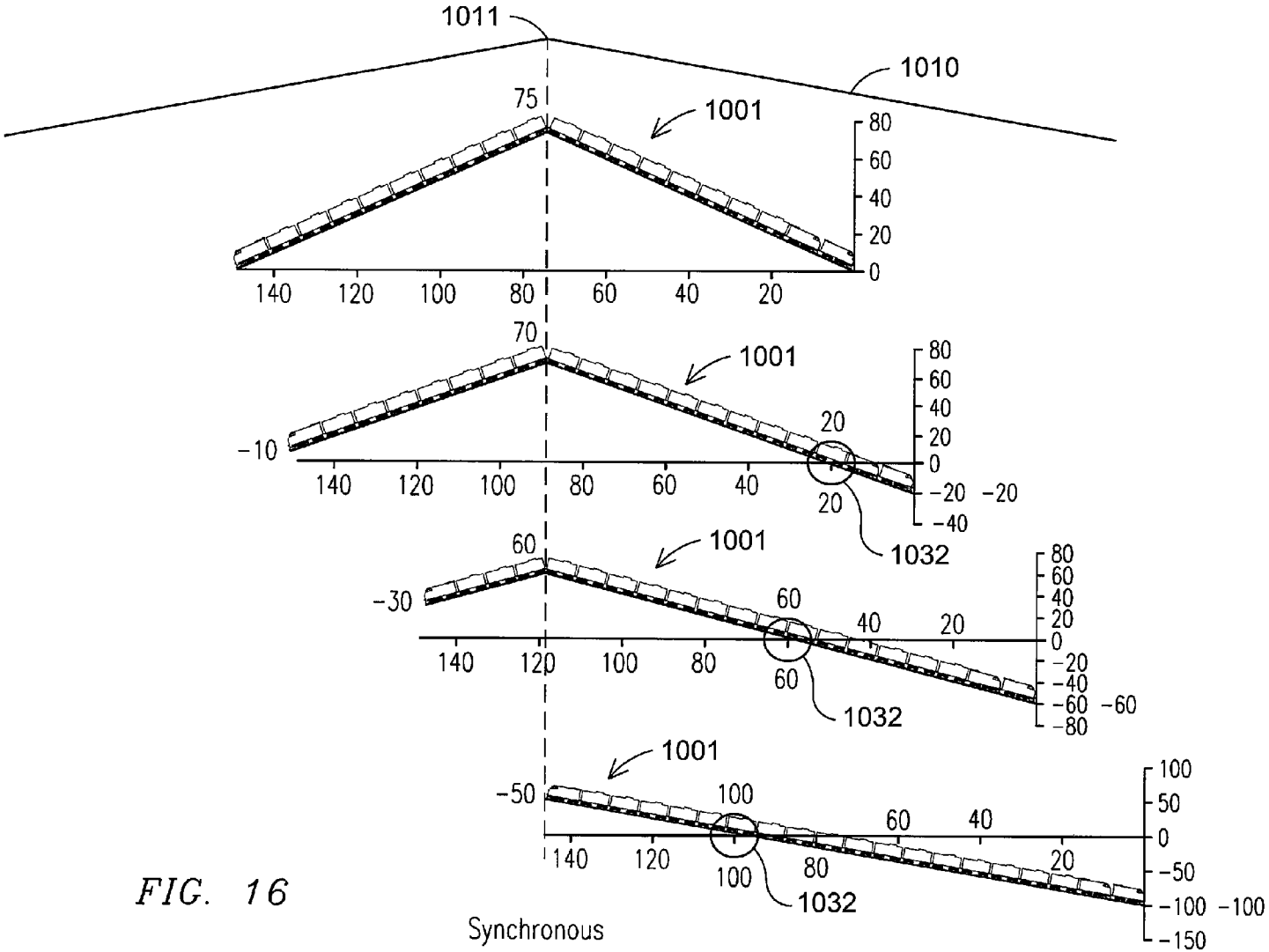
FIG. 16 illustrates a schematic diagram of a synchronous locomotive consist configured to pass over a hill having a uniform grade.

When the front of the train 1001 arrives at a peak 1011 of the hill 1010, 100 cars are being pulled in tension by the lead locomotives 1006,1008, while 50 cars are being pushed in compression by the trail locomotive 1009 (see the top plot in FIG. 15). In the plots of FIGS. 15-16, the horizontal axis 1012 indicates the number of cars that have passed over the hill 1010. The output power 1014 of the trail locomotive 1009 is indicated at the left side of the plot, and the combined output power 1016 of the lead locomotives 1006, 1008 is indicated at the right side of the plot.

The output power 1014,1016 is measured in units of the required power to hold one of the cars of the train 1001 on the side of the hill 1010 (i.e., the required power to prevent a single car from sliding down the hill 1010). Additionally, a slack location 1018 is illustrated which represents a location of zero force, or an effective break in the train 1001 between a rear train 1060 powered by the trail locomotive 1009 and a front train 1062 powered by the lead locomotives 1006,1008. The slack location 1018 is based on the output powers 1014,1016 and the number of cars along the horizontal axis 1012 which have passed over the peak 1011 of the hill 1010. For example, in the bottom plot of FIG. 15, with 60 cars having passed over the peak 1011 of the hill 1010, and thus 90 cars of the 150 car train 1001 still to pass over the peak 1011 of the hill 1010, a net force of 30 cars is exerted toward the rear of the train 1001. Thus, based on the 2/1 power distribution of the lead locomotives 1006,1008 and trail locomotive 1009, in order to maintain the steady-state condition, the output power 1014 of the trail locomotive 1009 is 10, while the output power 1016 of the lead locomotives 1006,1008 is 20. Since 60 cars have passed over the peak 1011 of the hill 1010, and the output power 1016 of the lead locomotives 1006,1008 is 20, a peak force 1020 of 80 (see FIG. 18) is present at the peak 1011 of the hill 1010. Thus, this peak force 1020 will cancel-out at a slack location 1018 positioned at 80 cars from the peak 1011 of the hill 1010 toward the rear of the train 1001, or 140 cars from the front of the train 1001. The peak force 1020 present at the peak 1011 of the hill 1010 is based on the output powers 1014,1016, and the slack location 1018. FIG. 15 illustrates the output powers 1014,1016, slack locations 1018, and peak force 1020, as half of the train 1001 has passed over the peak 1011 of the hill 1010. FIG. 16 features similar plots as FIG. 15 as the train 1001 reaches half-way over the peak 1011 of the hill 1010 (e.g., 75 cars of a 150 car consist), until the train 1001 is completely over the peak 1011 of the hill 1010. As an additional example, when 120 cars have passed over the peak 1011 of the hill 1010 (shown in the third plot of FIG. 16), 120 cars are being pulled over the hill 1010 while the remaining 30 cars are being pushed up the hill 1010, resulting in a net of 90 cars being pulled over the hill 1010. Based on the 2/1 power distribution for the lead locomotives 1006,1008 and trail locomotive 1009, the output power 1014 of the trail locomotive 1009 is −30, while the output power 1016 of the lead locomotives 1006, 1008 is −60, in order to maintain the steady speed condition. Since the output power 1014 of the trail locomotive is −30, and 30 cars have still to climb the hill 1010, a net force of 60 toward the rear of the train 1001 is present which is balanced out by 60 cars from the peak 1011 of the hill 1010 toward the front of the train 1001, resulting in a slack location 1018 at 60 cars from the front of the train 1001. The peak force 1020 at the peak 1011 of the hill 1010 is similarly 60 units of force.

Figure 17:
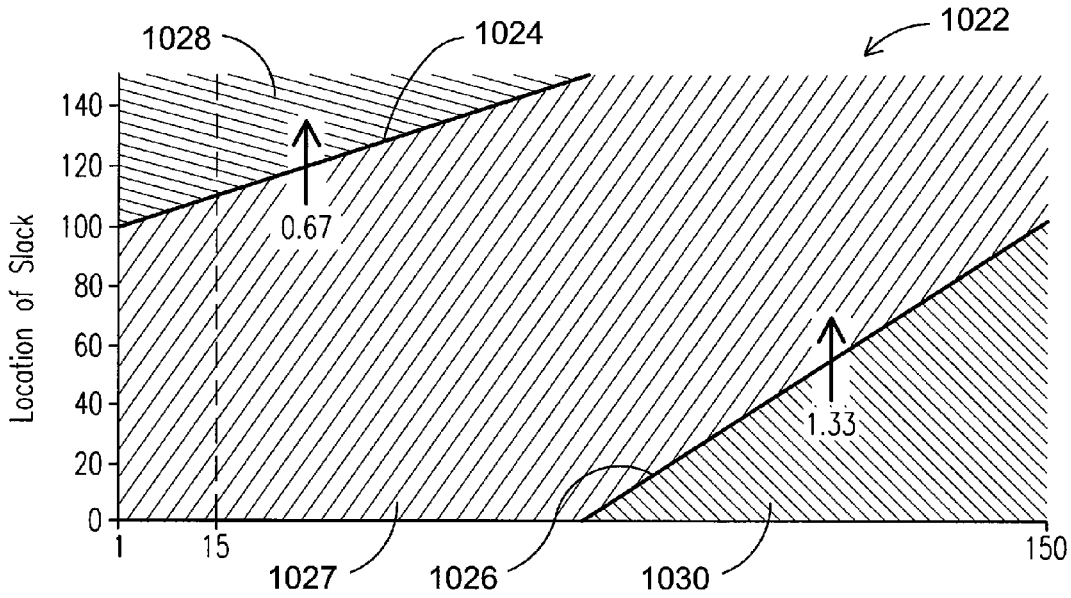
FIG. 17 illustrates an exemplary plot of the slack location versus the number of cars in the synchronous locomotive consist having passed over the hill in FIGS. 15-16.

FIG. 17 illustrates a plot 1022 of the slack location 1018 (vertical axis) versus the number of cars which have passed over the peak 1011 of the hill 1010 (horizontal axis). A top line 1024 represents the slack location 1018 from the front of the train 1001, for less than 75 cars having passed over the peak 1011 of the hill 1010 (see FIG. 15). As previously discussed, however, the present invention may be utilized for a train of any length and configured with any type of locomotive consist arrangement, other than the 2×1 arrangement, and thus FIG. 17 will vary based on these parameters. In an exemplary embodiment, the slope of the top line 1024 is 0.67, for example. Thus, for every car that passes over the peak 1011 of the hill 1010 (up to 75), the slack location 1018 increases by 0.67 toward the rear of the train 1001. The bottom line 1026 is defined by the slack location 1018 from the front of the train 1001, for more than 75 cars having passed over the peak 1011 of the hill 1010 (see FIG. 16). In an exemplary embodiment, the slope of the bottom line 1026 is 1.33, for example. Thus, for every car that passes over the peak 1011 of the hill 1010 (beyond 75), the slack location 1018 increases by 1.33 toward the rear of the train 1001. The top and bottom line 1024,1026 define two compression regions 1028,1030, separated by a tension region 1027. For example, the second plot in FIG. 15 demonstrates that for 15 cars having passed over the peak 1011 of the hill 1010, the first 110 cars are in tension being pulled by the lead locomotives 1006,1008, while the remaining 40 cars are in compression being pushed by the trail locomotive 1009. A vertical line from the horizontal axis in FIG. 17 at approximately 15 demonstrates these two properties. Additionally, the top and bottom lines 1024,1026 are oriented in the same direction and do not intersect over the length of the train 1001, for example. The previous example assumes a uniform distribution of cars along the train 1001, having equal length, and that the slope and location of the slack locations may be calculated based on the weight distribution (weight and length of the car) and the terrain and forces exerted by the locomotives 1006,1008,1009, for example.

Figure 18:
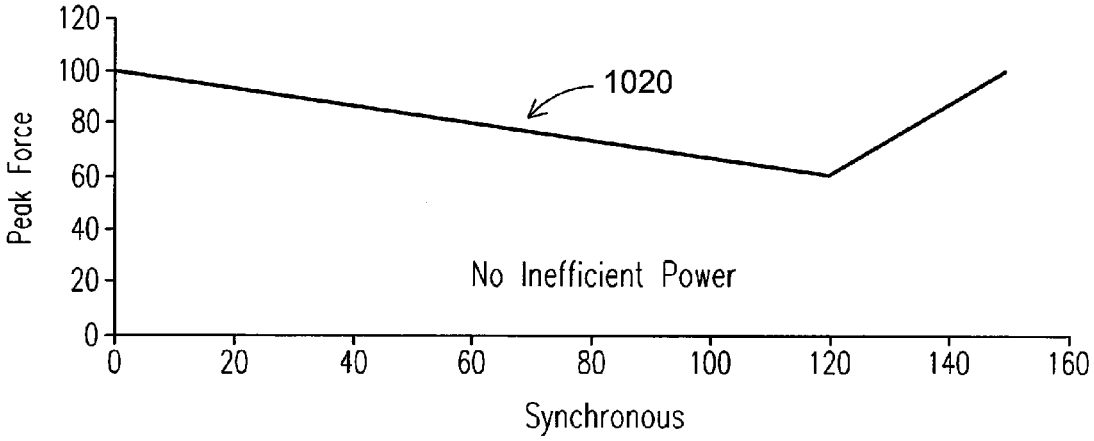
FIG. 18 illustrates an exemplary plot of the peak force at the peak of the hill versus the number of cars in the synchronous locomotive consist having passed over the hill in FIGS. 15-16.
Figure 19:
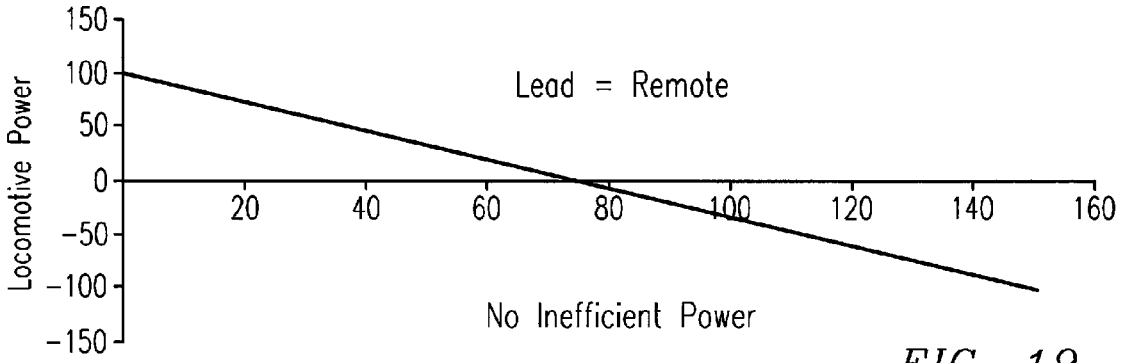
FIG. 19 illustrates a plot of the maximum percentage power of the locomotives in the locomotive consist versus the number of cars in the synchronous locomotive consist having passed over the hill in FIGS. 15-16.

In the exemplary plot of FIG. 18, the peak force 1020 (vertical axis) is plotted based on the number of cars which have passed over the peak 1011 of the hill 1010. As indicated in the plot, the peak force 1020 gradually decreases from 100 to 60, then increases back to 100 as the train passes over the peak 1011 of the hill 1010. Since this embodiment of FIGS. 15-18 involves a synchronous arrangement of the two lead locomotives 1006,1008 outputting a collective power of twice that of the trail locomotive 1009, the respective power of each lead locomotive 1006,1008 equals the power of the trail locomotive 1009 (generally done by having the same motoring or braking notch call on all of the locomotives). Thus, based on a percentage scale, FIG. 19 illustrates a plot of the output power, in terms of a percentage of the maximum power, as the number of cars pass over the peak 1011 of the hill 1010. As illustrated in the top of FIG. 16, when 75 cars have passed over the peak 1011 of the hill 1010, the output power of both the lead locomotive(s) 1006,1008 and trail locomotive 1009 is zero. Since FIG. 19 illustrates that the lead locomotives 1006,1008 and the trail locomotive 1009 share the same simultaneous mode (e.g., braking or motoring), the train 1001 does not experience any inefficient power which may arise when locomotives in different consists are operating in different modes. In the embodiments of FIGS. 15-18, since the lead locomotives 1006,1008 of the lead locomotive consist and the trail locomotive 1009 of the trail locomotive consist operate in the same operating mode as the train 1001 travels over the hill 1010, no inefficient power is experienced.

Figure 22:
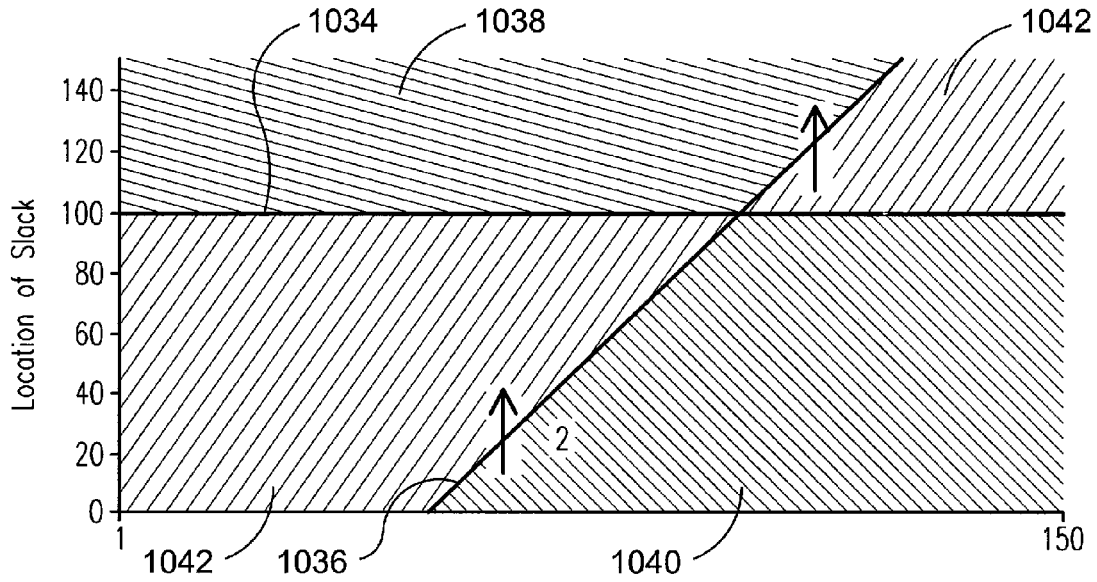
FIG. 22 illustrates an exemplary plot of the slack location versus the number of cars in the locomotive consist having passed over the hill in FIGS. 20-21.
Figure 23:
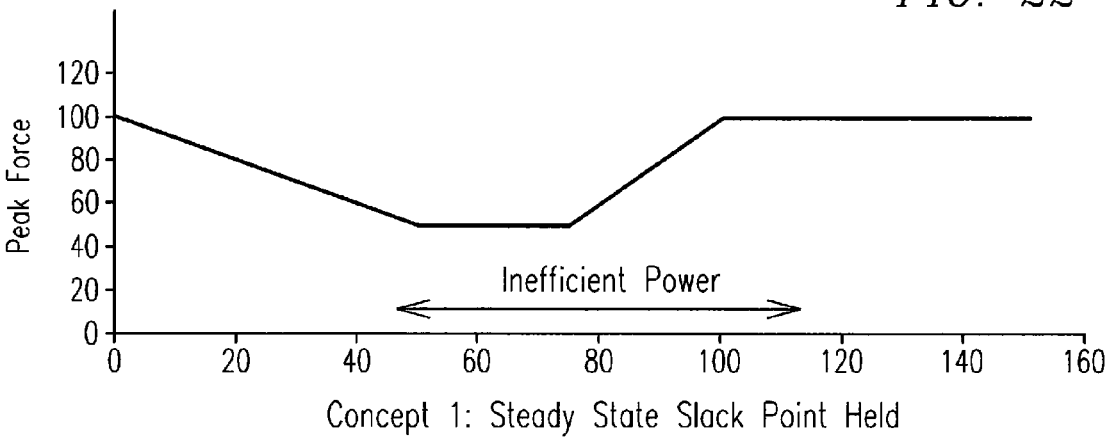
FIG. 23 illustrates an exemplary plot of the peak force at the peak of the hill versus the number of cars in the locomotive consist having passed over the hill in FIGS. 20-21.
Figure 20:
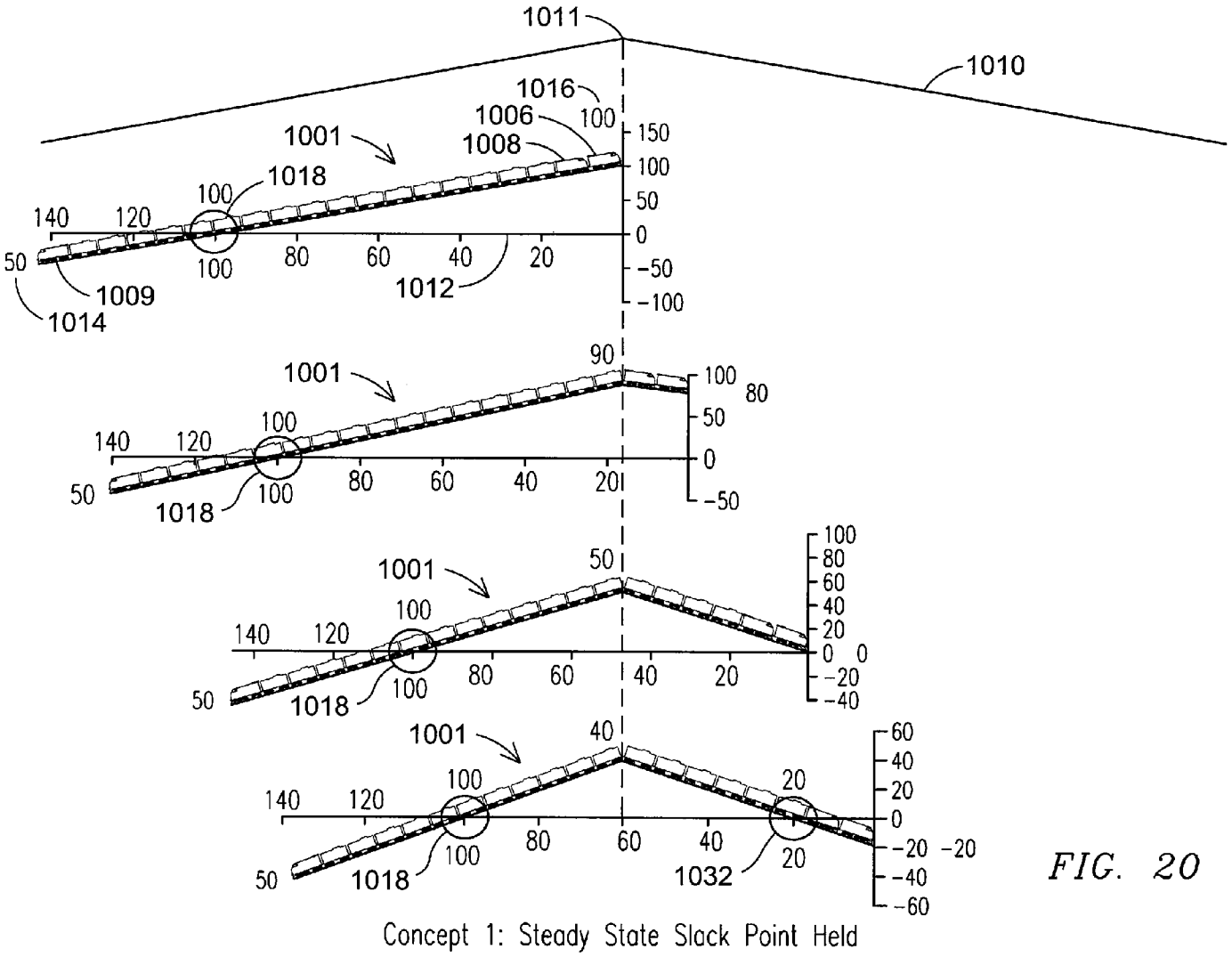
FIG. 20 illustrates a schematic diagram of a locomotive consist with a constant slack location configured to pass over a hill having a uniform grade.
Figure 21:
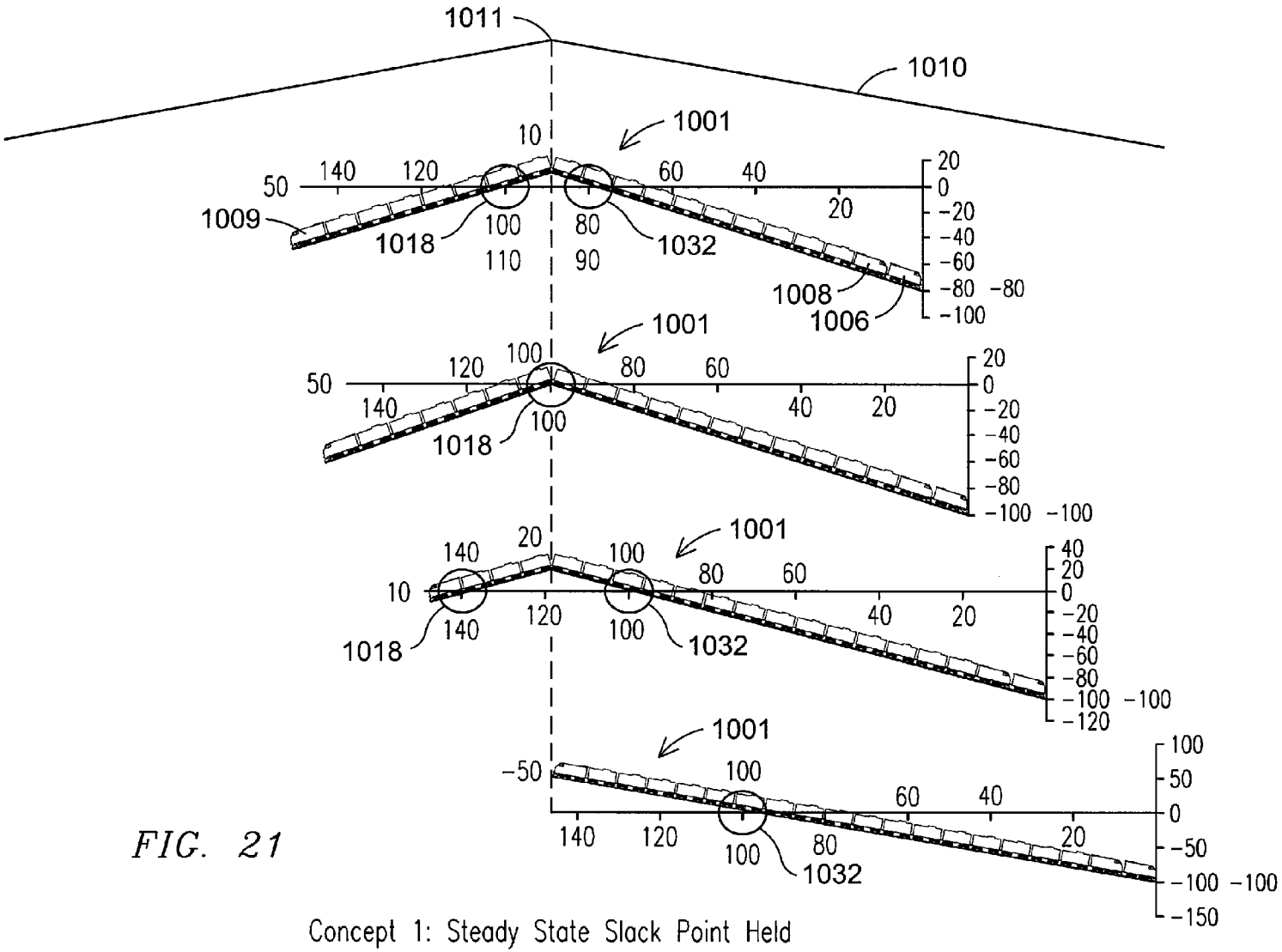
FIG. 21 illustrates a schematic diagram of a locomotive consist with a constant slack location configured to pass over a hill having a uniform grade.
Figure 24:
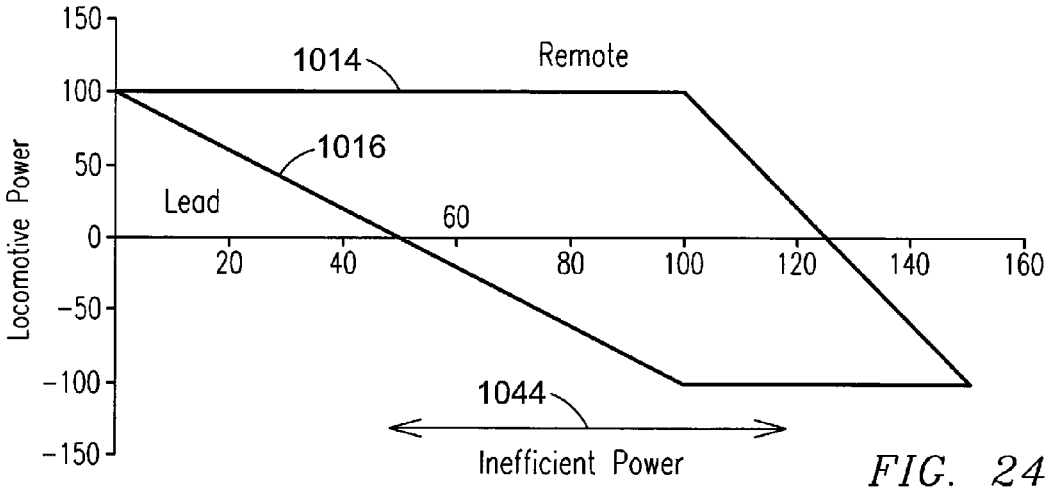
FIG. 24 illustrates a plot of the maximum percentage power of the locomotives in the locomotive consist versus the number of cars in the synchronous locomotive consist having passed over the hill of FIGS. 20-21.

In the exemplary embodiment of FIGS. 20-23, the 2×1 train 1001 operates such that the slack location 1018 is fixed at 100 cars from the front of the train 1001. However, the slack location may be fixed at any location along the train 1001, and, as previously mentioned, the locomotive consist arrangement of the train may vary from the 2×1 arrangement illustrated in FIGS. 20-23. Additionally, the train 1001 no longer operates so that the lead locomotives 1006,1008 output twice the power output of the trail locomotive 1009 (or in the same notch or synchronous operation, however it runs in asynchronous operation, since each consist is commanding different notches). As illustrated in the first three plots of FIG. 20, the output power 1014 of the trail locomotive 1009 is 50 and the slack location 1018 is fixed at 100 cars from the front of the train 1001, until 50 cars have gone over the peak 1011 of the hill 1010. In the fourth plot of FIG. 20, when 60 cars have gone over the peak 1011 of the hill 1010, 40 cars between the slack location 1018 and the peak 1011 of the hill 1010 result in a net force of 20 toward the front of the train 1001, and thus the output power 1016 of the lead locomotives 1006,1008 is −20, resulting in a second slack location 1032 at 20 cars from the front of the train 1001. As illustrated in FIG. 21, in which the train 1001 continues over the peak 1011 of the hill 1010, the second slack location 1032 moves towards the fixed slack location 1018, and when 100 cars have passed over the peak 1011 of the hill 1010, the first and second slack locations 1018,1032 intersect each other at 100 cars from the front of the train 1001 (see second plot in FIG. 21). FIG. 22 illustrates a plot similar to FIG. 17 of a first line 1034 of the slack location 1018 measured from the front of the train 1001, based on the number of cars which pass over the peak 1011 of the hill 1010, and a second line 1036 of the second slack location 1032 measured from the front of the train 1001, based on the number of cars which pass over the peak 1011 of the hill 1010. As with FIG. 17, the first line 1034 and second line 1036 define two compression regions 1038,1040 and a tension region 1042. In an exemplary embodiment, the slope of the second line 1036 is 2, meaning that for every car which passes over the peak 1011 of the hill 1010, the slack location 1032 shifts 2 cars toward the rear of the train 1001 (i.e., the slack location shifts at a greater rate than the 2×1 locomotive consist arrangement in which the lead locomotives output twice the power of the trail locomotive). Unlike FIG. 17, in which the top and bottom lines 1024,1026 were oriented in the same direction, the first and second lines 1034,1036 are not oriented in the same direction, and intersect over the length of the train 1001 (approximately when 100 cars have passed over the peak 1011 of the hill 1010). Also, similar to FIG. 18, FIG. 23 illustrates the peak force 1020 (vertical axis) based on the number of cars which have passed over the peak 1011 of the hill 1010. FIG. 24 also illustrates the output powers 1014,1016 (on a relative percentage scale), as with FIG. 19, and an inefficient power region 1044 (where the energy is generated in one locomotive consist and dissipated in another locomotive consist) is present in which the output powers 1014,1016 have opposite polarity or sign, from approximately 50-120 cars having passed over the peak 1011 of the hill 1010. For example, the bottom plot of FIG. 20, in which the output powers 1014, 1016 were 50 and −20, respectively, when 60 cars have passed over the peak 1011 of the hill 1010, could be replaced by a single output power of 30, and thus is a condition of inefficient power in terms of the outputs of the lead locomotives 1006,1008 of the lead locomotive consist and the trail locomotive 1009 of the trail locomotive consist.

Figure 25:
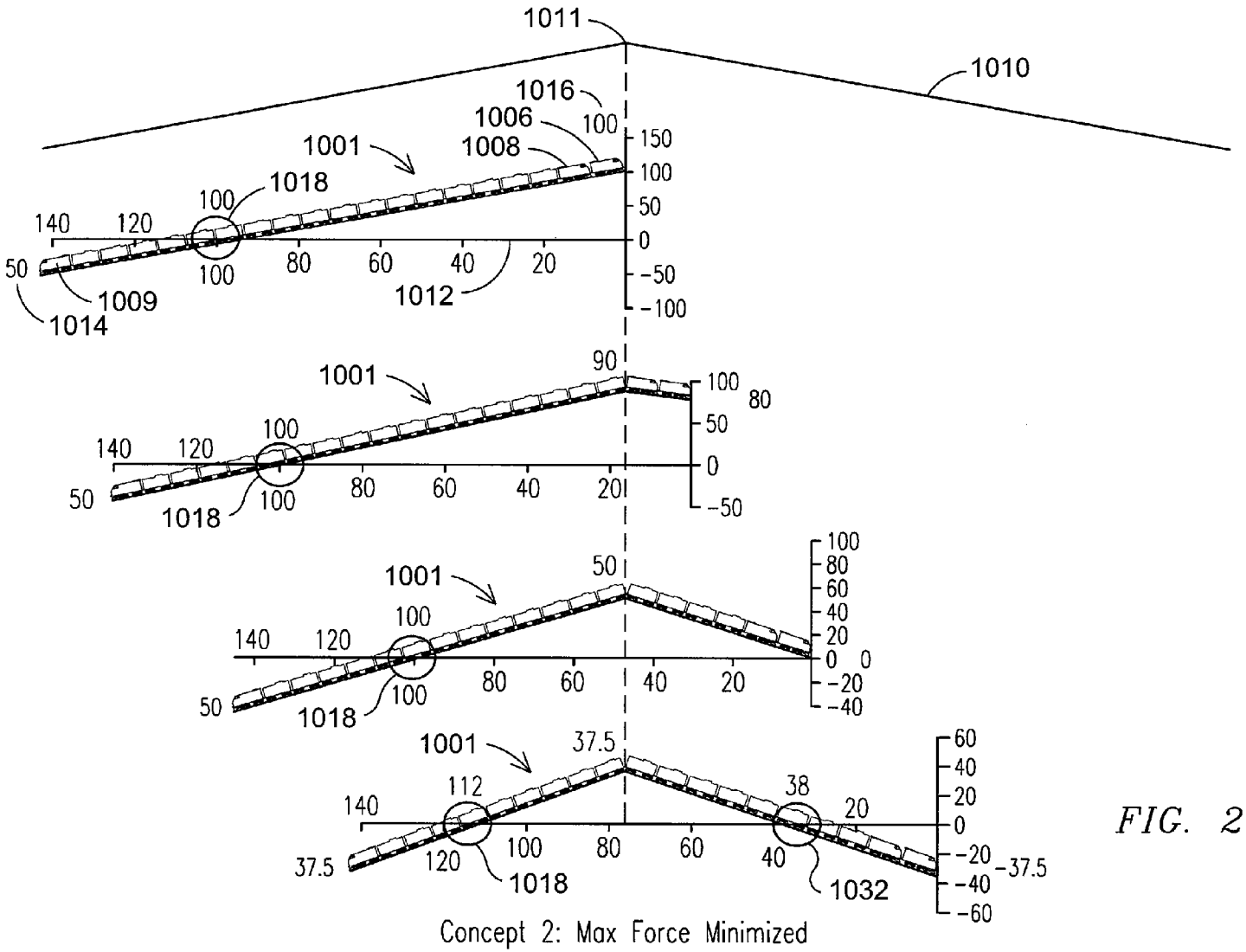
FIG. 25 illustrates a schematic diagram of a locomotive consist in which the maximum power of the locomotives within the consist is minimized, and the locomotive consist is configured to pass over a hill having a uniform grade.
Figure 26:
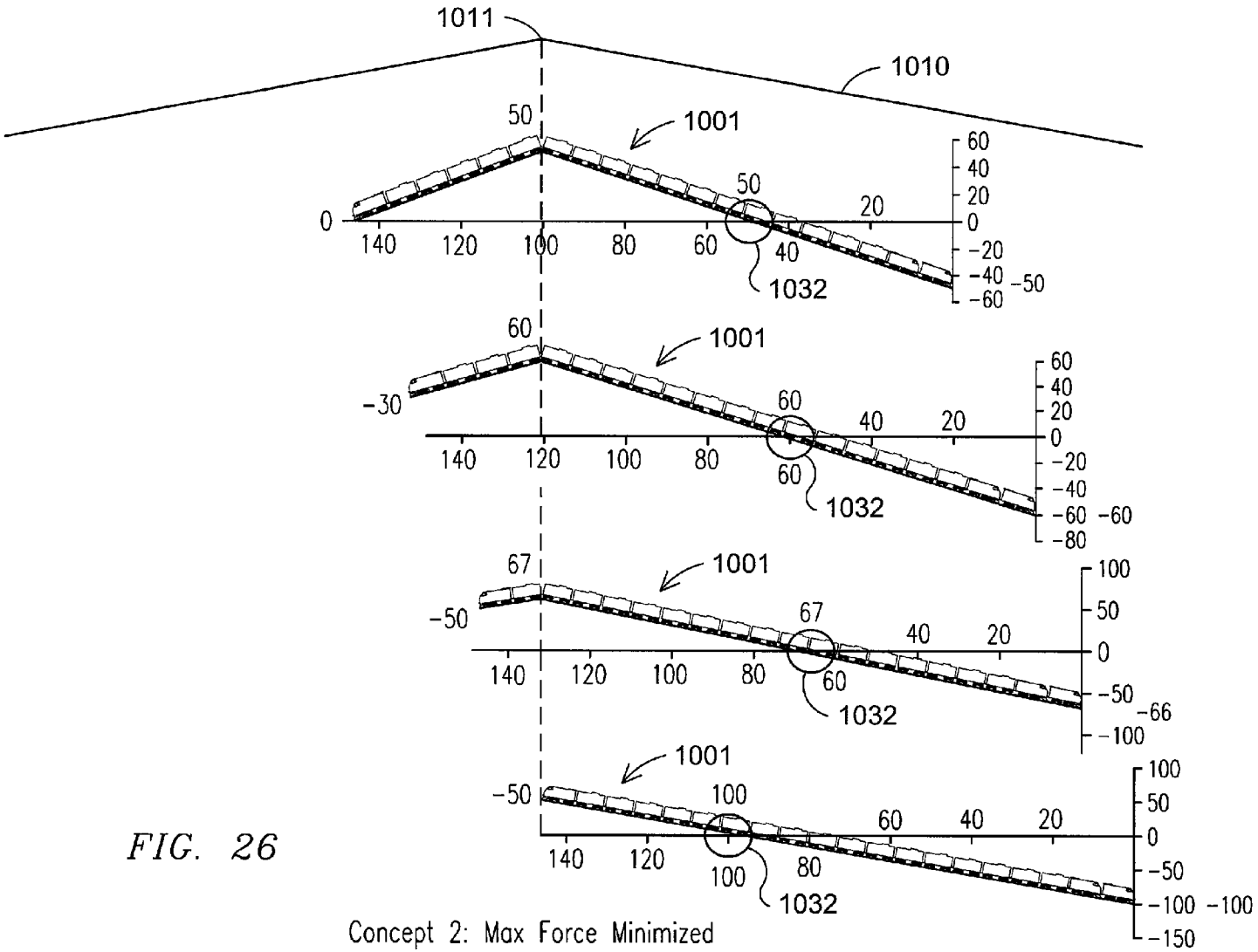
FIG. 26 illustrates a schematic diagram of a locomotive consist in which the maximum power of the locomotives within the consist is minimized, and the locomotive consist is configured to pass over a hill having a uniform grade.

In the exemplary embodiment of FIGS. 25-29, the 2×1 train 1001 is operated under the assumption that the maximum force within the train is minimized by controlling the output power 1014,1016 from either of the trail locomotive 1009 or lead locomotives 1006,1008 so to maintain the steady speed condition. Thus, the 2×1 train 1001 is not operated such that the lead locomotives 1006,1008 output twice that of the trail locomotive 1009, or operated such that a slack location is fixed at a particular location along the train 1001, as in the above embodiments. FIGS. 25-26 illustrate the respective output powers 1014,1016 and slack locations 1018, as the train 1001 passes over the peak 1011 of the hill 1010. In the bottom plot of FIG. 25, when 75 cars have passed over the peak 1011 of the hill 1010, the output powers 1014,1016 are 37.5 and −37.5, respectively, while a first slack location 1018 is positioned at 112 cars from the front of the train 1001, and a second slack location 1032 is positioned at 38 (rounded to an integer car) cars from the front of the train 1001.

Figure 27:
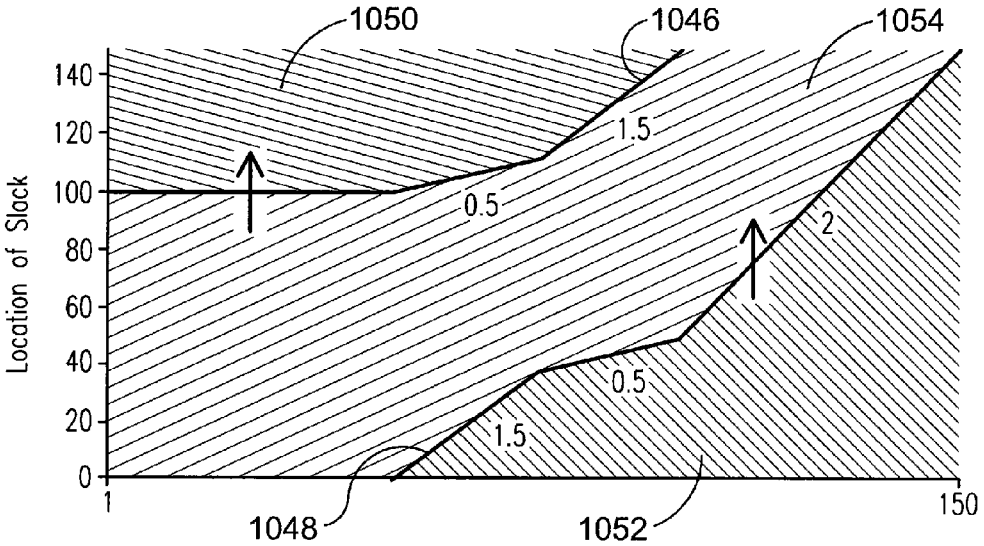
FIG. 27 illustrates an exemplary plot of the slack location versus the number of cars in the locomotive consist having passed over the hill in FIGS. 25-26.

FIG. 27 illustrates a plot, similar to FIGS. 17 and 22, in which a first line 1046 is based on the slack location 1018 measured from the front of the train 1001, and a second line 1048 is based on the second slack location 1032 measured from the front of the train 1001, as the number of cars pass over the peak 1011 of the hill 1010. The plot of FIG. 27 is based on minimizing the maximum force within the train 1001, as discussed above. Unlike FIG. 22, in which the first and second lines 1034,1036 converge as indicative of the convergence/intersect of the slack locations 1018,1032 as the train 1001 travels over the peak 1011 of the hill 1010, the first and second lines 1046,1048 in FIG. 27 are oriented in the same direction and do not converge/intersect as the length of the train 1001 travels over the peak 1011 of the hill 1010. As with FIGS. 17 and 22, the first and second lines 1046,1048 define a pair of compression regions 1050,1052 and a tension region 1054. In an exemplary embodiment, the slope of the first line 1046 varies from 0.5 to 1.5 as the train 1001 passes over the peak 1011 of the hill 1010. In an exemplary embodiment, the slope of the second line 1048 varies between 0.5 and 2 as the train 1001 passes over the peak 1011 of the hill 1010.

Figure 28:
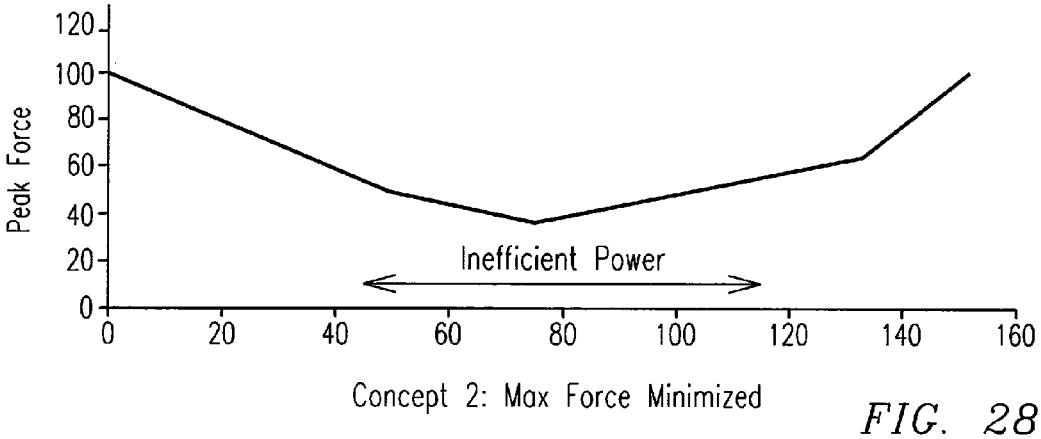
FIG. 28 illustrates an exemplary plot of the peak force at the peak of the hill versus the number of cars in the locomotive consist having passed over the hill in FIGS. 25-26.
Figure 29:
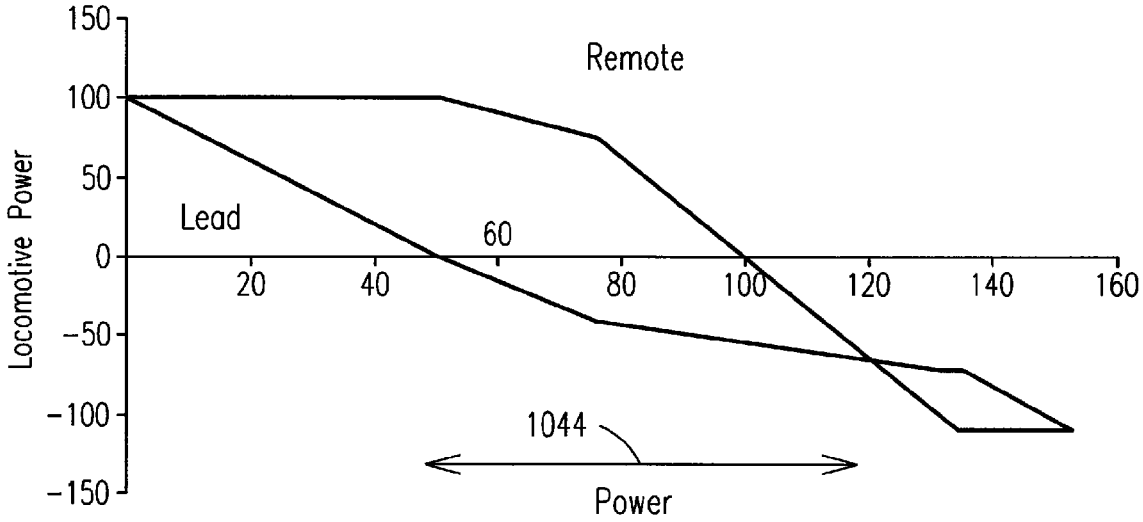
FIG. 29 a plot of the maximum percentage power of the locomotives in the locomotive consist of FIGS. 25-26.

In FIG. 28, the peak force 1020 (vertical axis) is plotted based on the number of cars having passed over the peak 1011 of the hill 1010. Additionally, FIG. 29 illustrates the respective output powers 1014,1016 of the trail locomotive 1009 and lead locomotives 1006,1008 (on the percentage scale), as the train 1001 passes over the peak 1011 of the hill 1010. An inefficient power region 1044 is based on the number of cars having passed over the peak 1011 of the hill 1010 in which the outputs powers 1014,1016 have opposite polarity/sign, represented by the lead locomotives 1006, 1008 of the lead locomotive consist and the trail locomotive 1009 of the trail locomotive consist operating in different modes (e.g., motoring or braking), as discussed above.

The embodiments of FIGS. 15-29 discussed above are based on conditions of steady speed, a uniform grade hill 1010, an even weight distribution of cars within the train 1001, as well as various power configurations (e.g., 2×1) of the locomotive consist(s), for example. However, a locomotive consist will more commonly operate under varying conditions, as it encounters a hill or travels along a railroad having a non-uniform grade, requires frequent acceleration or deceleration depending on the grade and mission parameters, and typically features non-uniform weight distribution. Thus, the present invention provides an algorithm which is necessary to operate an asynchronous or synchronous locomotive consist with maximum efficiency, in terms of the output powers of the trail locomotive and lead locomotive(s), and avoid unwanted conditions, as discussed below.

Figure 30:
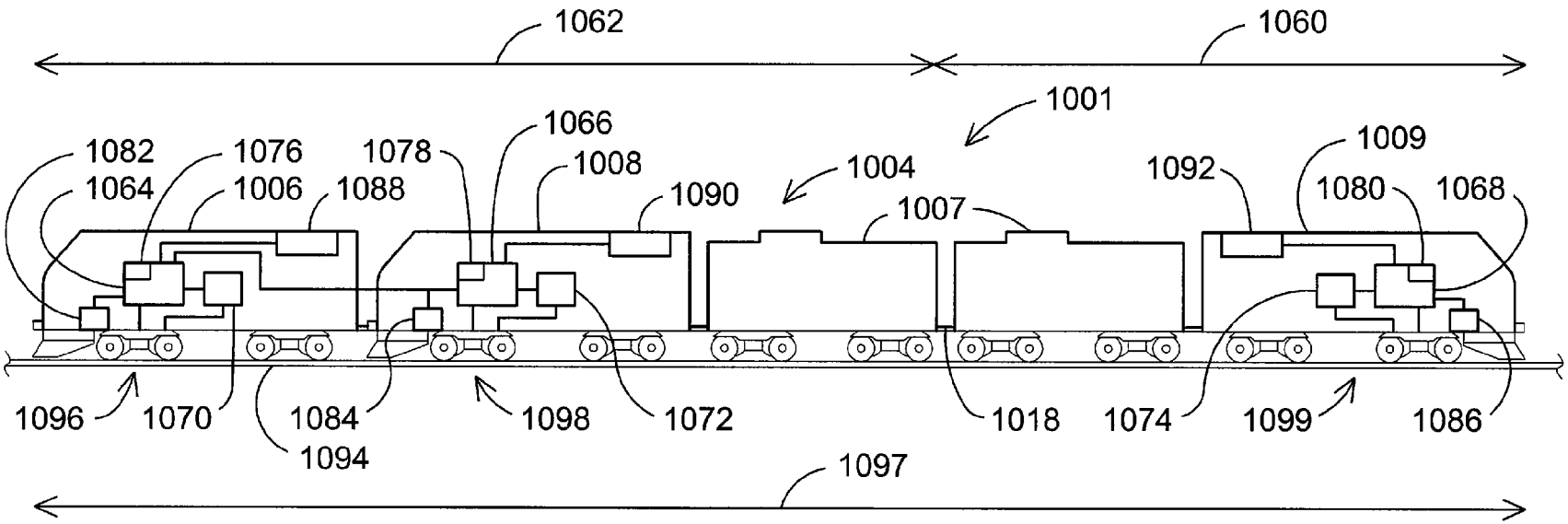
FIG. 30 is an exemplary embodiment of the locomotive consist illustrated in FIGS. 15-16, 20-21 and 25-26.

FIG. 30 illustrates an exemplary embodiment of a train 1001 traveling along a route 1094, such as the 2×1 locomotive consist configuration discussed above, including the lead locomotives 1006,1008 and the trail locomotive 1009, separated by a plurality of train cars 1007. The locomotives 1006,1008,1009 include a respective controller 1064,1066, 1068, which have a respective memory 1076,1078,1080. Additionally, the locomotives 1006,1008,1009 include a respective engine 1070,1072,1074, which is respectively coupled to the controller 1064,1066,1068. The respective output power levels of the engines 1070,1072 of the lead locomotives 1006,1008 are determined by the controllers 1064,1066. However, as illustrated in FIG. 30, the controller 1064 of the lead locomotive 1006 is coupled to the controller 1066 of the lead locomotive 1008, and thus the controller 1064 may determine the output power of the engines 1070, 1072, and communicate the output power of the engine 1072 to the controller 1066, for example. The output power of the engine 1074 of the trail locomotive 1009 is determined by the controller 1068 of the trail locomotive 1009.

As further illustrated in FIG. 30, the controllers 1064, 1066,1068 are coupled to a respective sensor 1082,1084, 1086 on the respective locomotive 1006,1008,1009, which may measure one or more parameters related to the operation of the locomotive and transmit this measured parameter data to the respective controllers 1064,1066,1068, such as speed, acceleration, and/or force at the joint of the locomotive and a train car or between train cars. However, the sensors 1082,1084,1086 are not limited to measuring the above-listed parameters, and may measure and transmit data related to any parameter related to the operation of the respective locomotive. A position determination device 1088,1090,1092 is respectively positioned within the locomotives 1006,1008,1009, such as a transceiver in communication with one or more global positioning system (GPS) satellites (not shown), for example, to obtain location information of the respective locomotive. The position determination device 1088,1090,1092 is respectively coupled to the controller 1064,1066,1068, and provides the location information to the controller as the train 1001 travels at incremental/successive locations along the route 1094. The respective memory 1076,1078,1080 of the locomotives 1006,1008,1009 stores one or more parameters such as: a grade of the route 1094 at incremental locations; a correlation table of position information of the locomotive along the route 1094 based on position information provided by the position determination device; one or more characteristic(s) of the locomotive such as a maximum power of the engine, a weight of the locomotive, and a length of the locomotive; and one or more characteristics of the train such as a locomotive configuration of the train, a maximum power of each locomotive, a weight of the train and a length 1097 of the train, for example. In an exemplary embodiment, the controllers 1064,1066,1068 will determine the slack locations 1018,1032, on an instantaneous basis, for example, and adjust the output power of the respective engines of the locomotives 1006,1008,1009, such that the movement of the slack locations 1018,1032 is in a common direction, thus avoiding the convergence of the slack locations 1018,1032 along the length of the train 1001. As a secondary objective, the controllers 1064,1066,1068 may adjust the output powers of the engines of the locomotives 1006,1008,1009, such that the rate of change of the slack locations 1018,1032 is minimized (or otherwise reduced or controlled), after it is determined that the slack locations 1018,1032 are projected to travel in a common direction.

In an exemplary embodiment, the controller 1064 of the lead locomotives 1006,1008, and the controller 1068 of the trail locomotive 1009 may predetermine an output power of the engine 1070,1072,1074 at incremental locations along the route 1094, prior to or during a trip, so to optimize a performance characteristic of the locomotives 1006,1008, 1009, such as maximizing fuel efficiency, for example. The process by which the controllers 1064,1066,1068 predetermine the output power of the respective engine 1070,1072, 1074 at the incremental locations along the route 1094 is discussed in U.S. patent application Ser. No. 11/385,354/ U.S. Patent Publication No. 2007/0219680A1, which is incorporated by reference herein in its entirety. In the embodiments of the present invention, the controllers 1064, 1066,1068 may modify the predetermined output powers of the engines 1070,1072,1074, such that the rate of change of any slack locations 1018,1032 within the train 1001 are minimized (or otherwise reduced or controlled) and/or the movement of any slack locations 1018,1032 within the train 1001 is in a common direction. As discussed above, the respective memory 1076,1078,1080 has a stored recommended output power for each engine, based on the locomotive characteristics, the train characteristics (including the locomotive consist configuration), the grade of the route, and/or an operating parameter of the locomotive and/or train. Thus, the respective controller 1064,1066,1068 may compare the predetermined output power with the recommended power, and determine whether or not the predetermined output power of the respective engines (1070,1072) (1074) needs to be adjusted, in order to maintain the ideal handling conditions involving the slack locations. Thus, for example, if the predetermined output power determined by the controllers (1064,1066)(1068) for the lead engines (1070,1072) and trail engine (1074) is 1000 horsepower (hp) and 500 hp, but the recommended output power is 800 horsepower (hp) and 400 hp, the controllers (1064,1066) (1068) may modify the predetermined output power of the engines (1070,1072)(1074) to 800 hp and 400 hp, respectively, such that the handling issues regarding the slack locations 1018,1032 are addressed. The controllers 1064, 1066,1068 may predetermine the output power and the memory 1076,1078,1080 may store a recommended power, based upon one or more of the 2×1 power locomotive consist arrangement, the fixed slack location arrangement or the 2×1 minimal power locomotive consist arrangement, discussed in the above embodiments. The incremental locations may vary in their separation along the route 1094, from a scale of feet to yards and/or miles, based upon such parameters as the length of the trip. However, the incremental locations may be fixed by the controllers 1064,1066,1068, regardless of the length of the trip, for example.

The controllers 1064,1066,1068 may forecast the development of a slack location 1018 and/or the movement of a slack location 1018,1032 along the length of the train 1001, based on one or more of: the measured parameter data received from the respective sensor 1082,1084,1086; the current grade of the route 1094 received from the respective memory 1076,1078,1080; a weight distribution of the locomotive/train, retrieved from the respective memory 1076, 1078,1080; and/or a characteristic of the train/locomotive retrieved from the respective memory 1076,1078,1080, for example.

An algorithm may be programmed within the controllers 1064,1066,1068, that provides a control method such that when a single slack location is present on the train 1001, the output power of the trail locomotive 1009 and/or lead locomotive(s) 1006,1008 is minimized. Thus, subsequent to determining that a slack location is present on the train 1001, the control method minimizes the total magnitude of the engine outputs, based on the sum of the output powers 1014,1016, for example. The algorithm may provide that the controller 1064,1066,1068 will evaluate whether a single slack location 1018 will be present within some foreseeable period of time in the future, or whether multiple slack locations 1018,1032 may develop. The output power 1014, 1016 of the trail locomotive 1009 and/or the lead locomotive(s) 1006,1008 may be minimized in the event that a single slack location 1018 is foreseeable for some definite time period in the future, based on the retrieved grade of the route 1094, the characteristic(s) of the train 1001, such as the weight, the length, and the maximum output power of the engine(s), for example. The algorithm within the controllers 1064,1066,1068 may further provide that when two or more slack locations 1018,1032 are present on the train 1001 and/or foreseeable for some definite time period in the future, the output powers 1014,1016 of the trail locomotive 1009 and/or lead locomotive(s) 1006,1008 are adjusted such that the respective slack locations 1018,1032 move in the same relative direction along the train 1001, as the train 1001 travels over the route 1094, such as the hill 1010, for example. This adjustment of the output powers 1014,1016 ensures that the "effective front/rear trains" 1060, 1062 separated by the slack location 1018 do not effectively collide, which could lead to possible handling problems of the train 1001, for example. In the scenario of multiple slack locations 1018,1032, once the controller 1064,1066,1068 ensures that the slack locations 1018,1032 are moving in the same direction as the train 1001 moves through a region of the route 1094, the controller 1064,1066,1068 further adjusts the output power 1014,1016 of the lead locomotive(s) 1006,1008 and/or trail locomotive 1009 such that the time rate of change that the slack locations 1018, 1032 move (based on the relative movement of the train 1001, as previously discussed) is minimized, or at least reduced or otherwise controlled. Additionally, in the scenario of multiple slack locations 1018,1032, once the controller 1064,1066,1068 has ensured that the slack locations 1018,1032 are both moving in the same direction as the train 1001 moves, and the rate of change of movement of the slack locations 1018,1032 is minimized (or reduced or otherwise controlled), the controller 1064,1066,1068 may further adjust the output power 1014,1016 of the lead locomotive(s) 1006,1008 and trail locomotive 1009 to reduce any region in which the output powers 1014,1016 of the lead locomotive(s) 1006,1008 and trail locomotive 1009 have opposite polarity/sign, as this would constitute a region of inefficient power. Thus, the controller 1064, 1066, 1068 may adjust the output power 1014,1016 such that the output power 1014,1016 has a same relative polarity, or a same polarity/sign, for example. Although the algorithm programmed within the controller 1064,1066,1068 discussed above features the above steps being enacted in the discussed order, the steps may be rearranged, such as ensuring that the rate of change of the slack locations 1018,1032 are minimized, followed by ensuring that the slack locations 1018,1032 are moving in the same direction as the train 1001 moves through a region of the route 1094, for example. Additionally, the output powers 1014,1016 may be adjusted such that the respective slack locations 1018,1032 maintain an independent location and thus do not intersect over the length of the train 1001.

In an exemplary embodiment, the controller 1064,1066, 1068 within the train 1001 may determine the expected direction of movement of the slack location 1018 based on the output power 1014,1016 of the trail locomotive 1009 and lead locomotive(s) 1006,1008, for example. For example, if the tractive effort of the lead locomotive 1006,1008 is reduced, the slack location 1018 may move in the same direction as a direction of travel, while if the tractive effort of the lead locomotive 1006,1008 is increased, the slack location 1018 may move in an opposite direction to the direction of travel and may collide with a second slack location 1032.

At each instant in time, the train 1001 may encounter a hill (not shown) of varying terrain, and have a varying number of cars 1007 pass over the hill, for example. The controller 1064,1066,1068 is provided with the direction of travel, from the sensors 1082,1084,1086, such as a speed sensor, for example, and thus, is aware that more cars 1007 of the train 1001 will travel over the hill at a next time instant. The controller 1064,1066,1068 is also provided with the locations of one or more slack locations 1018,1032 along the train 1001 at each time instant from one or more force sensors positioned between each car 1007, for example. The controller 1064,1066,1068 is configured to determine whether an output power 1014,1016 of the lead/trail locomotive (1006,1008)(1009) should be increased or decreased, based upon whether or not this increase or decrease amounts to the slack locations 1018,1032 traveling the same or opposite directions. Additionally, the controller 1064,1066, 1068 will increase or decrease the output power 1014,1016 of the lead/trail locomotive (1006,1008)(1009), and determine the extent to increase or decrease the output power 1014,1016, based upon how much this affects the rate of change of the slack location(s) 1018,1032 on the train 1001.

In an exemplary embodiment, the algorithm of the present invention may involve a control method such that, at each time instant along the travel plan, the controller 1064,1066, 1068 will determine between four possibilities: (1) increase the lead locomotive output power 1016 and decrease the trail locomotive output power 1014, (2) decrease the lead locomotive output power 1016 and increase the trail locomotive output power 1014, (3) increase the lead locomotive output power 1016 and increase the trail locomotive output power 1014, and (4) decrease the lead locomotive output power 1016 and decrease the trail locomotive output power 1014. Additionally, since the controller 1064,1066,1068 is aware of the total increase/decrease in the combined trail and lead locomotive output powers 1014,1016, the controller 1064, 1066,1068 can determine the net force increase/decrease on the train 1001. For example, if a net force of 2 toward the front of the train 1001 is required, the controller may determine between (1) increasing the lead locomotive output power 1016 by 2, or (2) increasing the trail locomotive output power 1014 by 2. In this example, if increasing the lead locomotive output power 1016 by 2 amounts to two slack locations 1018,1032 moving in the same direction, while increasing the trail locomotive output power 1014 amounts to the two slack locations 1018,1032 moving in opposite directions, then the controller 1064,1066,1068 will increase the lead locomotive output power 1016. The controller 1064,1066,1068 may determine the direction of movement of the slack locations 1018,1032, based on the grade of the route 1094, the weight of the train 1001, the weight distribution profile of the train 1001 (stored in the respective memory 1076,1078,1080), and whether the train 1001 is accelerating or decelerating. Upon determining whether the train 1001 is to accelerate or decelerate, the controller 1064,1066,1068 determines the total net force required, what the effective grade of each car within the train 1001 is, and determines the expected location of the slack locations 1018,1032 based on an increase/decrease in the output powers 1014,1016 of the trail or lead locomotives. Based on these expected locations of the slack locations 1018,1032, the controller 1064,1066,1068 determines whether to increase/decrease the respective output powers 1014,1016 of the trail/lead locomotive(s) within the train 1001.

Figure 31:
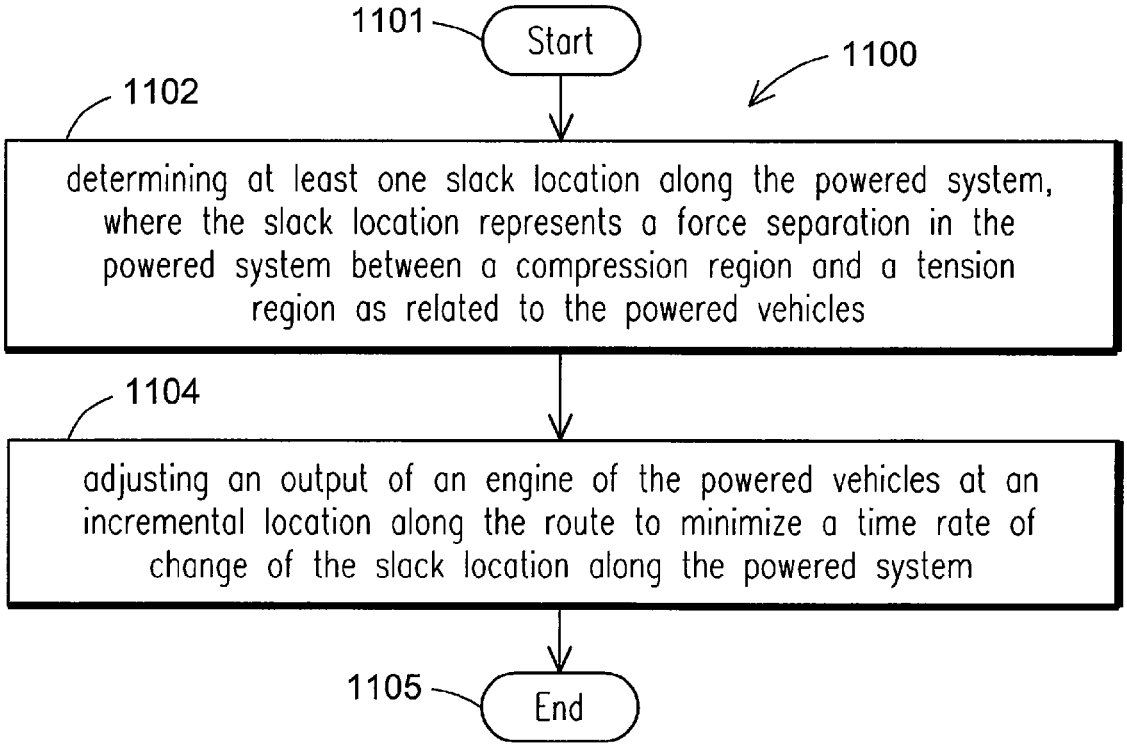
FIG. 31 is a flow chart of an exemplary embodiment of a method for improving the handling of the locomotive consist traveling along a route.

FIG. 31 is a flowchart illustrating an exemplary embodiment of a method 1100 for improving the handling of a powered system, such as a train 1001 or other group of linked vehicles, for example, traveling along a route 1094. The train 1001 includes two lead locomotives 1006,1008, a trail locomotive 1009, and train cars 1007 positioned in between. The locomotives 1006,1008,1009 and train cars 1007 are mutually coupled together. The method 1100 begins at 1101 by determining 1102 at least one slack location 1018 along the train 1101, where the slack location 1018 represents a force separation in the train 1001 between two respective regions as related to the locomotives 1006, 1008,1009. "Force separation" refers to one region of the train experiencing one type of force and another region experiencing another, different type of foce. Thus, the two respective regions of the train 1001 (FIG. 30) include a compression region subject to a compression force and a tension region subject to a tension force. The method 1100 further includes adjusting 1104 an output 1014,1016 of an engine (1070,1072)(1074) of the locomotives (1006,1008) (1009) at an incremental location along the route 1094 to minimize a time rate of change of the slack location 1018 along the train 1001, before ending at 1105.

Based on the foregoing specification, the above-discussed embodiments of the invention may be implemented using computer programming or engineering techniques including computer software, firmware, hardware or any combination or subset thereof, wherein the technical effect is to improve the handling of a powered system traveling along a route. Any such resulting program, having computer-readable code means, may be embodied or provided within one or more computer-readable media, thereby making a computer program product, i.e., an article of manufacture, according to the discussed embodiments of the invention. The computer readable media may be, for instance, a fixed (hard) drive, diskette, optical disk, magnetic tape, semiconductor memory such as read-only memory (ROM), etc., or any transmitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will easily be able to combine the software created as described with appropriate general purpose or special purpose computer hardware, such as a microprocessor, to create a computer system or computer sub-system of the method embodiment of the invention. An apparatus for making, using or selling embodiments of the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody those discussed embodiments the invention.

This written description uses examples to disclose the various embodiments of the invention, including the best mode, and also to enable any person skilled in the art to make and use the invention. The patentable scope of the invention is defined by the claims and may include other examples that occur to those skilled in the art. Such other examples are intended to be within the scope of the claims if they have structural elements that do not differ from the literal language of the claims or if they include equivalent structural elements with insubstantial differences from the literal languages of the claims.

What is claimed is:

1. A control system comprising:

a controller configured to determine first and second slack locations in a powered system having first and second powered vehicles capable of self-propulsion, the first and second powered vehicles disposed in respective first and second consists that are separated by at least one other vehicle that is incapable of self-propulsion in the powered system, each of the first and second slack locations representing a force separation in the powered system between a compression region and a tension region, the compression region including one or more couplers in the powered system that are subject to a compression force and the tension region including one or more couplers in the powered system that are subject to a tension force;

wherein the controller is configured to be coupled to a first engine of at least one of the first or second powered vehicles, the controller being configured to adjust a first output of the first engine to control a rate of change of at least one of the first or second slack locations in the powered system and to cause the first and second slack locations to move in a common direction in the powered system relative to the first and second powered vehicles and the at least one other vehicle.

2. The control system of claim 1, wherein the controller also is configured to adjust the first output of the first engine to cause the first and second slack locations to remain stationary in the powered system relative to the first and second powered vehicles and the at least one other vehicle.

3. The control system of claim 1, wherein the first powered vehicle includes the first engine and the second powered vehicle includes a second engine having a second output, the controller configured to be coupled to the second engine, and wherein the controller is configured to adjust the first and second outputs of the respective first and second engines such that the first and second outputs of the engines have a common polarity.

4. The control system of claim 1, wherein the first powered vehicle includes the first engine and the second powered vehicle includes a second engine having a second output, and wherein the controller is configured to be coupled to the second engine to adjust the first and second outputs of the respective first and second engines such that a total magnitude of the first and second outputs is reduced.

5. The control system of claim 1, wherein the controller also is configured to adjust the first output of the first engine such that at least one of the first or second slack locations in the powered system remains fixed in the powered system.

6. The control system of claim 1, wherein:

the second powered vehicle includes a second engine having a second output, the powered system includes a third powered vehicle having a third engine with a third output and a fourth powered vehicle having a fourth engine with a fourth output, the third powered vehicle in the first consist with the first powered vehicle, the fourth powered vehicle in the second consist with the second powered vehicle, the first consist located ahead of the second consist along a direction of travel of the powered system; and wherein the controller is configured to adjust the first and third outputs of the respective first and third engines of the respective first and third powered vehicles to be collectively at least twice a magnitude of the second and fourth outputs of the respective second and fourth engines of the respective second and fourth powered vehicles.

7. The control system of claim 1, wherein the controller is configured to forecast whether at least one of the first or second slack locations will form in the powered system at a future time based on at least one of a parameter of a route being traveled by the powered system, a characteristic of the powered system, or an operating parameter of the powered system.

8. The control system of claim 7, wherein the controller includes a memory that is configured to store at least one of the parameter of the route or the characteristic of the powered system; and further comprising a sensor configured to be coupled to the controller to measure the operating parameter of the powered system.

9. The control system of claim 7, wherein the first consist is disposed ahead of the second consist along a direction of travel of the powered system; and wherein, upon the controller having determined the first and second slack locations, the controller is configured to control a direction of movement of the first and second slack locations within the powered system based on the direction of travel of the powered system along a route and the first and second outputs from the respective first and second powered vehicles.

10. The control system of claim 1, wherein the controller is configured to control the common direction in which the first and second slack locations move relative to a direction of travel of the powered system based on a controlled adjustment of the output from the first and second powered vehicles within the powered system.

11. The control system of claim 1, wherein the controller is configured to reduce the first output of the first engine such that the common direction in which the first and second slack locations move within the powered system coincides with a direction of travel of the powered system.

12. The control system of claim 1, wherein the controller is configured to increase the first output of the first engine such that the common direction in which the first and second slack locations move within the powered system is opposite to a direction of travel of the powered system.

13. The control system of claim 1, wherein the controller is configured to control the first output of the first engine in such that a time rate of change of movement of the first and second slack locations within the powered system is reduced.

14. The control system of claim 1, wherein the first powered vehicle includes the first engine and the second powered vehicle includes a second engine having a second output, and wherein the controller is configured to also be coupled to the second engine and the first consist is positioned ahead of the second consist along a direction of travel of the powered system; and wherein the controller is configured to adjust the first and second outputs of the respective first and second engines to control the rate of change of the at least one of the first or second slack locations and to cause the first and second slack locations to move within the powered system in the common direction by at least one of:

increasing the first output of the first engine and increasing the second output of the second engine;

increasing the first output of the first engine and decreasing the second output of the second engine;

decreasing the first output of the first engine and increasing the second output of the second engine; or decreasing the first output of the first engine and decreasing the second output of the second engine.

15. A method comprising:

determining a first slack location in a powered system having first and second powered vehicles capable of self-propulsion, the first and second powered systems disposed in respective first and second consists that are separated by at least one other vehicle that is incapable of self-propulsion in the powered system, the first slack location representing a first force separation in the powered system a compression region and a tension region, the compression region including one or more couplers that are subject to a compression force and the tension region including one or more couplers that are subject to a tension force; and adjusting a first output of a first engine of at least one of the first powered vehicle or the second vehicle to reduce a rate of change of the first slack location and to maintain a first location of the first slack location in the powered system.

16. The method of claim 15, further comprising determining a second slack location in the powered system, the second slack location representing a second force separation in the powered system; and wherein adjusting the first output of the first engine causes the first slack location to maintain the first location and the second slack location to maintain a second location in the powered system.

17. The method of claim 15, wherein the first powered vehicle includes the first engine and the second powered vehicle includes a second engine; and further comprising adjusting of a second output of the second engine such that the first and second outputs of the respective first and second engines have a common polarity.

18. The method of claim 15, wherein the first powered vehicle includes the first engine and the second powered vehicle includes a second engine having a second output; and wherein adjusting the first output of the first engine is performed such that a total magnitude of the first and second outputs is reduced.

19. A control system comprising:

a controller configured to determine first and second slack locations in a powered system having first and second powered vehicles capable of self-propulsion, the first powered vehicle disposed in a first consist of the powered system and the second powered vehicle disposed in a second consist of the powered system, each of the first and second slack locations representing a force separation in the powered system between a compression region and a tension region, the compression region including one or more couplers that are subject to a compression force and the tension region including one or more couplers that are subject to a tension force;

wherein the controller is configured to adjust a first power output of a first engine in at least one of the first or second powered vehicles to at least one of control a direction of movement of the first and second slack locations relative to the first and second powered vehicles within the powered system or maintain where the first and second slack locations are disposed within the powered system.

20. The control system of claim 19, wherein the controller is configured to adjust the first power output of the first engine to control a rate of change of at least one of the first or second slack locations in the powered system.

21. The control system of claim 19, wherein the controller is configured to adjust the first power output of the first engine such that the first and second slack locations move in the same direction of movement relative to the first and second powered vehicles in the powered system.

* * * * *